US007522051B2

(12) United States Patent
Sanari et al.

(10) Patent No.: US 7,522,051 B2
(45) Date of Patent: Apr. 21, 2009

(54) RECORDING CONTROL APPARATUS, RECORDING CONTROL METHOD, CONTROL PROGRAM, RECORDING MEDIUM ON WHICH CONTROL PROGRAM IS RECORDED, RECORDING CONTROL SYSTEM, AND INFORMATION PROCESSING SYSTEM

(75) Inventors: Kosuke Sanari, Kyoto-fu (JP); Tetsuo Nishidai, Kyoto-fu (JP); Shigeru Okuno, Kyoto-fu (JP)

(73) Assignee: Omron Corporation (JP)

( * ) Notice: Subject to any disclaimer, the term of this patent is extended or adjusted under 35 U.S.C. 154(b) by 431 days.

(21) Appl. No.: 11/433,385

(22) Filed: May 15, 2006

(65) Prior Publication Data

US 2006/0267770 A1 Nov. 30, 2006

(30) Foreign Application Priority Data

May 13, 2005 (JP) ..... 2005-141869

(51) Int. Cl.
*G08B 13/14* (2006.01)

(52) U.S. Cl. ..... 340/572.1; 340/572.4; 340/572.8; 340/539.13; 340/539.32; 340/995.19; 340/995.22; 235/375; 235/382; 235/384; 235/385; 701/209; 701/210

(58) Field of Classification Search ..... 340/572.1, 340/572.4, 572.8, 539.13, 539.32, 995.19, 340/995.22; 235/375, 382, 384, 385; 701/209, 701/210

See application file for complete search history.

(56) References Cited

U.S. PATENT DOCUMENTS

| | | | | |
|---|---|---|---|---|
| 7,044,373 | B1 * | 5/2006 | Garber et al. | 235/385 |
| 7,419,095 | B2 * | 9/2008 | Yoshioka et al. | 235/384 |
| 2004/0128066 | A1 * | 7/2004 | Kudo et al. | 701/204 |

* cited by examiner

*Primary Examiner*—Tai T Nguyen
(74) *Attorney, Agent, or Firm*—Dickstein Shapiro LLP

(57) ABSTRACT

Provided according to the invention is a recording control apparatus capable of more accurately recording an image of a person carrying an article to which an RFID tag is attached. When a reader/writer receives position information on an RFID tag attached to an article, this information is stored in an article information storing section. When a position determining unit detects an article located out of a designated area, a monitoring camera control section starts controlling recording. The monitoring camera control section estimates the movement direction of the article based on the time-sequential record of the position information on the article, specifies any of monitoring cameras to be operated based on the movement direction and the current position of the article, and controls the recording operation of the specified monitoring camera.

7 Claims, 15 Drawing Sheets

| ID INFORMATION | ARTICLE NAME | ROBBERY OCCURRENCE FLAG | CURRENT POSITION | 50 msec. BEFORE | 100 msec. BEFORE | 150 msec. BEFORE | ... |
|---|---|---|---|---|---|---|---|
| 0001 | aaa | | X=**, Y=** | X=**, Y=** | X=**, Y=** | X=**, Y=** | ... |
| 0002 | bbb | 1 | X=**, Y=** | X=**, Y=** | X=**, Y=** | X=**, Y=** | ... |
| 0003 | ccc | | X=**, Y=** | X=**, Y=** | X=**, Y=** | X=**, Y=** | ... |
| 0004 | ddd | | X=**, Y=** | X=**, Y=** | X=**, Y=** | X=**, Y=** | ... |
| ... | ... | | ... | ... | ... | ... | ... |

FIG. 5

RECORDING CONTROL APPARATUS, RECORDING CONTROL METHOD, CONTROL PROGRAM, RECORDING MEDIUM ON WHICH CONTROL PROGRAM IS RECORDED, RECORDING CONTROL SYSTEM, AND INFORMATION PROCESSING SYSTEM

BACKGROUND OF THE INVENTION

1. Field of the Invention

The present invention relates to a recording control apparatus, a recording control method, a control program, a recording medium on which a control program is recorded, a recording control system, and an information processing system, used for control over image recording of supervision targets to which RFID tags are attached.

2. Background Art

Currently, a detection system using RFID tags has been widely employed as a technique for detecting illegal takeout of commodities such as shoplifting and robbery in stores or other places. According to this system, an RFID tag is attached to each commodity, and a gate containing an antenna for transmitting and receiving radio waves to and from the RFID tag is equipped in the vicinity of the entrance and exit of a store. When a person bringing a commodity passes through the gate without permission, the antenna contained in the gate communicates with the RFID tag and detects illegal takeout of the commodity.

For example, JP-A-2004-135045 (publication date: Apr. 30, 2004) discloses a system for preventing illegal use of electronic equipment. According to this system, a reader/writer is provided on a credit terminal equipped at the checkout counter in a store, and an RFID tag is fixed to the checkout counter. The credit terminal constantly judges whether the credit terminal is communicating with the RFID tag in the normal condition. When it is determined that the credit terminal cannot communicate with the RFID tag in the normal way, a security process is executed such that the ordinary functions of the credit terminal cannot be offered. Thus, when the credit terminal is stolen, illegal use of the credit terminal is prevented by suspending communication between the credit terminal and the RFID tag fixed to the checkout counter.

Additionally, JP-A-2003-317169 (publication date: Nov. 7, 2003) discloses a monitoring system which uses an RFID tag attached to a monitoring target and includes an image-recording/monitoring device provided with a unit for receiving output signals from the RFID tag. The recording/monitoring device determines the transmission direction based on the output signals from the RFID tag to follow the monitoring target so that the image of the target can be recorded and monitored. Thus, the monitoring system can record and monitor the image of the monitoring target as the moving body while recognizing and following the monitoring target.

However, in the system for detecting illegal takeout of commodities by recognizing the RFID tag using the antenna contained in the gate, the gate is required to be equipped at all the entrances and exits in the store. It is therefore necessary to decrease the number of the entrances and exits in the store to the smallest possible number or to provide a lot of gates containing the antenna. Moreover, this system cannot detect illegal takeout through routes other than through the gates.

The system disclosed in JP-A-2004-135045 can prevent illegal use of stolen electronic equipment, but cannot prevent robbery itself.

The system disclosed in JP-A-2003-317169 can only determine the transmission direction of the RFID tag and follow the monitoring target so that the image of the target can be recorded and monitored. It is thus possible that an image of the back of the person carrying the commodity to which the RFID tag is attached is recorded, for example. In this case, the image cannot be used as an evidence image showing robbery.

SUMMARY OF THE INVENTION

Accordingly, it is an object of the invention to provide a recording control apparatus, a recording control method, a control program, a recording medium on which a control program is recorded, a recording control system, and an information processing system, which are used for more accurately recording an image of a person carrying an article to which an RFID tag is attached.

In order to achieve the above object, a recording control apparatus according to the invention includes: a communication processing unit for receiving position information on an RFID tag from a tag communication device which can measure the position of the RFID tag through radio communication with the RFID tag; a database control unit for storing the position information on the RFID tag received by the communication processing unit in a database; and a recording control unit for controlling recording operation of a plurality of recording devices disposed at a plurality of positions. The recording control unit estimates the movement direction of the RFID tag based on the time-sequential record of the position information on the RFID tag stored in the database, reads disposition information on the plural recording devices from a database storing this disposition information to specify any of the recording devices to be operated to record a region including the location of the RFID tag based on the position information and the movement direction of the RFID tag, and controls the recording operation of the specified recording device.

A recording control method according to the invention includes: a position information receiving step for receiving position information on an RFID tag from a tag communication device which can measure the position of the RFID tag through radio communication with the RFID tag; a storing step for storing the position information on the RFID tag received by the communication processing unit in a database; and a recording control step for controlling recording operation of a plurality of recording devices disposed at a plurality of positions. In the recording control step, the movement direction of the RFID tag is estimated based on the time-sequential record of the position information on the RFID tag stored in the database, disposition information on the plural recording devices is read from a database storing this disposition information to specify any of the recording devices to be operated to record a region including the location of the RFID tag based on the position information and the movement direction of the RFID tag, and the recording operation of the specified recording device is controlled.

According to the above structure and method, the position information on the RFID tag is initially received from the tag communication device capable of measuring the position of the RFID tag. This information is stored in the database as the time-sequential record. Then, the movement direction of the RFID tag is estimated based on the time-sequential record of the position information, and any of the recording devices is specified based on the position information and movement direction. Thus, the recording device to be operated is selected and operated considering not only the position of the RFID tag but also the movement direction of the RFID tag. As a result, an image of a person carrying an article to which an RFID tag is attached, for example, can be more accurately recorded.

More specifically, when the recording device located before the RFID tag in motion is so controlled as to record the image of the RFID tag, for example, the image of the person carrying the article to which the RFID tag is attached as viewed substantially from the front can be recorded. Accordingly, the recording image from which the looks of the person is accurately recognizable can be offered.

The recording control apparatus according to the invention having the above structure may further include a position determining unit for determining whether the RFID tag the position information of which is received by the communication processing unit is located out of a predetermined area. In this case, when the position determining unit determines that the RFID tag is located out of the predetermined area, the recording control unit may control recording of the RFID tag.

In this structure, the RFID tag shifted from the predetermined area to the outside thereof is detected, and the image of the detected RFID tag is recorded. Thus, by providing such a system which can detect occurrence of robbery when the article to which the RFID tag is attached is moved out of the predetermined area, for example, the image of the robber can be accurately recorded at the time of robbery.

In the recording control apparatus according to the invention having the above structure, the recording control unit may command the recording devices to control panning or zoom based on the position information on the RFID tag and the disposition information on the recording device to be operated.

In this structure, since the panning and zoom are accurately controlled in accordance with the position of the RFID tag, the image of the RFID tag can be more accurately recorded. More specifically, since the recording direction and the zoom distance of the recording device are controlled based on the current position of the RFID tag, the recording image containing the person carrying the article to which the RFID tag is attached in appropriate size almost at the center of the recording image can be obtained, for example.

The recording control apparatus according to the invention having the above structure may further include an alarm control unit for controlling alarm operation of a plurality of alarms disposed at a plurality of positions. The alarm control unit may estimate the movement direction of the RFID tag based on the time-sequential record of the position information on the RFID tag stored in the database, read disposition information on the plural alarms from a database storing this disposition information to specify any of the alarms to be operated based on the position information and the movement direction of the RFID tag, and control the alarm operation of the specified alarm device. When the position determining unit determined that the RFID tag is located out of the predetermined area, the alarm control unit may control the alarm operation.

In this structure, the RFID tag shifted from the predetermined area to the outside thereof is detected, and the alarm to be operated is specified based on the detected position of the RFID tag. Thus, by providing such a system which can detect occurrence of robbery when the article to which the RFID tag is attached is moved out of the predetermined area, for example, alarm can be accurately given to the robber at the time of robbery.

The respective units included in the recording control apparatus may be provided using a computer. In this case, a control program under which a computer can provide functions of those units is used, and a recording medium on which the control program is recorded and from which a computer can read the control program is included within the scope of the invention.

A recording control system according to the invention includes: the recording control apparatus according to the invention; and a database for storing the position information on the RFID tag received by the communication processing unit and the disposition information on the plural recording devices.

An information processing system according to the invention includes: the recording control system according to the invention; and a tag communication device for measuring the position of an RFID tag through radio communication with the RFID tag.

In this structure, the recording device is selected and operated considering not only the position of the RFID tag but also the movement direction of the RFID tag. Thus, the image of the person carrying the article to which the RFID tag is attached, for example, can be more accurately recorded.

As explained above, the recording control unit of the recording control device according to the invention estimates the movement direction of the RFID tag based on the time-sequential record of the position information on the RFID tag stored in the database, reads disposition information on the plural recording devices from the database storing this disposition information to specify any of the recording devices to be operated to record a region including the location of the RFID tag based on the position information and the movement direction of the RFID tag, and controls the recording operation of the specified recording device.

In the recording control step of the recording control method according to the invention, the movement direction of the RFID tag is estimated based on the time-sequential record of the position information on the RFID tag stored in the database, disposition information on the plural recording devices is read from the database storing this disposition information to specify any of the recording devices to be operated to record a region including the location of the RFID tag based on the position information and the movement direction of the RFID tag, and the recording operation of the specified recording device is controlled.

Thus, the image of the person carrying the article to which the RFID tag is attached can be more accurately recorded. More specifically, when the recording device positioned before the RFID tag in motion is so controlled as to record the image of the RFID tag, for example, the image of the person carrying the article to which the RFID tag is attached as viewed substantially from the front can be recorded. Accordingly, the recording image from which the looks of the person are accurately recognizable can be offered.

BRIEF DESCRIPTION OF THE DRAWINGS

FIG. 5 shows an example of information stored in an article information storing section.

DESCRIPTION OF THE PREFERRED EMBODIMENTS

An embodiment according to the invention is hereinafter described with reference to the appended drawings. In this embodiment, a security system which detects robbery of articles as commodities and executes predetermined processes when robbery occurs in a store or other places is discussed.

(Structure of Security System)

Figure 2:
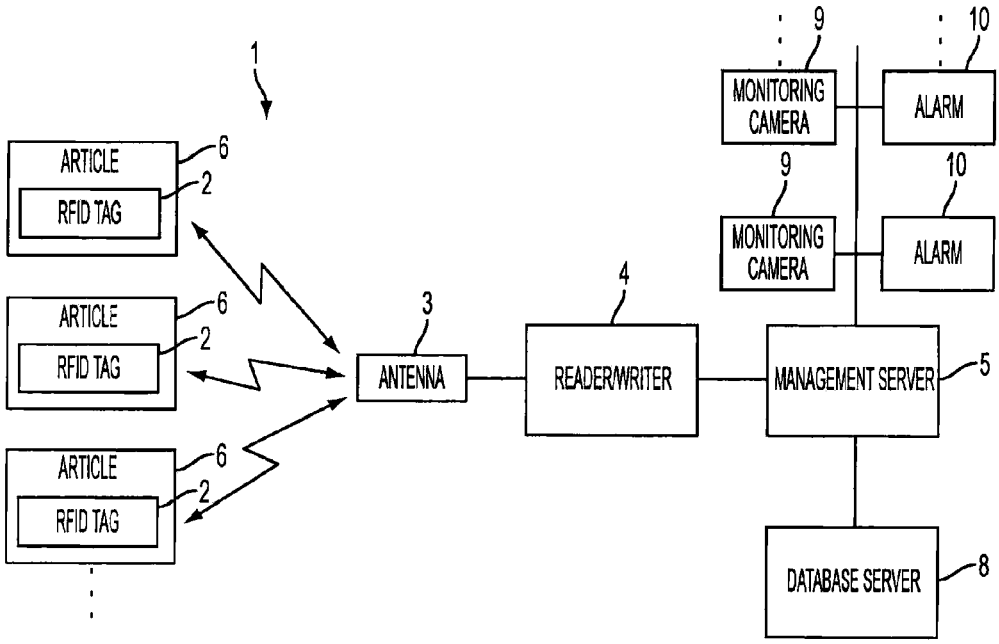
FIG. 2 is a block diagram schematically showing a structure of the security system.

FIG. 2 is a block diagram schematically showing a structure of a security system 1 in this embodiment. As illustrated in this figure, the security system 1 includes RFID tags 2 each of which is attached to corresponding articles 6 placed on a showcase or the like, an antenna 3, a reader/writer (tag communication device) 4, a management server 5, a database server 8, monitoring cameras (recording devices) 9, and alarms 10.

The RFID tags 2 are devices which store information on the articles 6 to which the RFID tags are attached. Each of the RFID tags 2 has an IC (integrated circuit) for radio communication, a storage section, an antenna, and other components. In this embodiment, the RFID tags used are of passive type which do not have power sources such as batteries but operate their circuits using electric power transmitted through radio waves from the reader/writer 4 so as to wirelessly communicate with the reader/writer 4. The RFID tags 2 used in this embodiment are not limited to the passive type RFID tags mentioned above but may be of active type containing power sources such as batteries.

The antenna 3 transmits radio waves to the RFID tags 2 and receives radio waves sent from the RFID tags 2. The antenna 3 is constituted by a patch antenna or an array antenna, for example. While the antenna 3 has both the transmission function and the reception function in this embodiment, a transmission antenna and a reception antenna may be separately provided.

The reader/writer 4 wirelessly communicates with the respective RFID tags 2 through the antenna 3 and reads and writes information stored in the RFID tags 2. While the reader/writer 4 has the function of reading and writing information stored in the RFID tags 2 in this embodiment, the reader/writer 4 may be of other type such as an RFID reader which only reads information stored in the RFID tags 2.

In this embodiment, the frequency band of the radio waves transmitted and received by the reader/writer 4 through the antenna 3 is the so-called UHF band in the range from about 800 MHz to about 960 MHz. By using the radio waves having the frequency band in this range, the reader/writer 4 can communicate with the RIFD tags 2 located within the range of distances from several meters to several tens of meters. While the UHF band radio waves is used for communication in this embodiment, the frequency band for the RFID tags may be 13.56 MHz band, 2.45 GHz band, or other frequency bands which allow radio communication.

The management server 5 detects robbery of the articles 6 based on the information about the respective articles 6 read by the reader/writer 4, and controls the processes which are to be executed when robbery occurs. The management server 5 is connected with the reader/writer 4 through a wired LAN cable, for example. The connection form between the management server 5 and the reader/writer 4 is not limited to the wired connection, but may be the wireless connection. The connection method between the management server 5 and the reader/writer 4 is not limited to the LAN connection, but may be other type of communication connections as long as the management server 5 and the reader/writer 4 can communicate with each other.

The database server 8 has a database which stores information about the articles 6 as the management targets and information about the guard area as an area to be guarded. The database server 8 is connected with the management server 5 through a wired LAN cable, for example. The connection form between the database server 8 and the management server 5 is not limited to the wired connection, but may be the wireless connection. The connection method between the database server 8 and the management server 5 is not limited to the LAN connection, but may be other type of communication connections as long as the database server 8 and the management server 5 can communicate with each other.

The monitoring cameras 9 are disposed at a plurality of positions within the guard area. The respective monitoring cameras 9 are connected with the management server 5 through a wired or wireless LAN cable, for example. The connection method between the monitoring cameras 9 and the management server 5 is not limited to the LAN connection, but may be other type of communication connections as long as the monitoring cameras 9 and the management server 5 can communicate with each other. The respective monitoring cameras 9 may have a panning function and/or a zooming function. The management server 5 controls the recording operation of the monitoring cameras 9 and receives picture data from the monitoring cameras 9.

The alarms 10 are disposed at a plurality of positions within the guard area. The respective alarms 10 are connected with the management server 5 through a wired or wireless LAN cable, for example. The connection method between the alarms 10 and the management server 5 is not limited to the LAN connection, but may be other type of communication connections as long as the alarms 10 and the management server 5 can communicate with each other. Examples of types of the alarms 10 involve voice-emission alarms which emit alarm sounds or alarm voices, display devices which displays information and images about warnings, and other types.

While one reader/writer 4 is connected with the management server 5 in FIG. 2, a plurality of the reader/writers 4 may be connected with the management server 5. In this case, the respective reader/writers 4 collect information from the plural RFID tags 2 and the management server 5 collects information on the respective articles 6 from the reader/writers 4. This structure allows supervision of all the articles 6 by the management server 5.

Additionally, a plurality of the antennas 3 may be connected with the respective reader/writers 4 so that signals received by the respective antennas 3 can be collectively transmitted to the reader/writers 4 and processed thereat.

(Structure of Reader/Writer)

Figure 3:
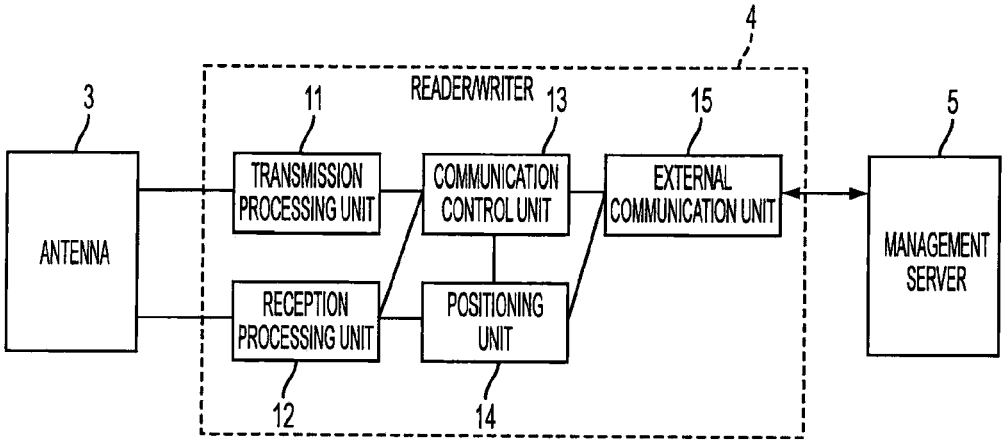
FIG. 3 is a block diagram schematically showing a structure of a reader/writer included in the security system.

The structure of the reader/writer 4 is now explained with reference to FIG. 3. As illustrated in this figure, the reader/writer 4 has a transmission processing unit 11, a reception processing unit 12, a communication control unit 13, a positioning unit 14, and an external communication unit 15.

The transmission processing unit 11 is a block for executing processes such as modulation and amplification of transmission signals transmitted through the antenna 3. The reception processing unit 12 is a block for executing processes such as amplification and demodulation of reception signals received by the antenna 3.

The communication control unit 13 is a block for controlling reading and/or writing of information from and to the RFID tags 2 as the communication targets through the antenna 3.

The positioning unit 14 is a block for measuring the positions of the RFID tags 2 based on the reception signals received from the RFID tags 2. Examples of the method for measuring the positions of the RFID tags 2, which method will be described later, involve a method of measuring the distances between the antenna 3 and the RFID tags 2, a method of measuring the directions of the RFID tags 2 as viewed from the antenna 3, a method of measuring spatial positions of the RFID tags 2, and other methods.

The external communication unit 15 is a block for transmitting the information read by the reader/writer 4 from the RFID tags 2 and the information on the positions of the RFID tags 2 to the management server 5, and for receiving the information to be written to the RFID tags 2 from the management server 5.

(Structures of Management Server and Database Server)

The structures of the management server 5 and the database server 8 are now described with reference to FIG. 1. The management server 5 has a communication processing unit 21, a control unit 22, a display unit 23, and an input unit 24.

The communication processing unit 21 functions as a communication interface of the management server 5, and performs processes for communication with the reader/writer 4 and the database server 8 through the LAN.

The display unit 23 displays operations and processes performed by the management server 5. The display unit 23 is constituted by a liquid crystal display device or other known display devices.

The input unit 24 receives commands to the management server 5 inputted by the operator. The input unit 24 is constituted by pointing devices such as a key board and a mouse or other devices.

The control unit 22 is a block for carrying out various information processes to be performed by the management server 5. The control unit 22 has an alarm control section 31, a monitoring camera control section (recording control unit) 32, a database control section 33, a guard process control section 34, and a position determining section 35.

The database control section 33 controls the processing of writing and reading information to and from the database server 8. The position determining section 35 determines whether the articles 6 have been moved out of a designated area which will be described later. Based on the judgment that the articles 6 have been moved out of the designated area, the position determining section 35 determines occurrence of robbery of the articles 6.

The guard process control section 34 commands the alarm control section 31 and the monitoring camera control section 32 to start operation at the time of robbery when the position determining section 35 determines that the articles 6 have been moved out of the designated area and thus detected occurrence of robbery.

The monitoring camera control section 32 controls the operation of the monitoring cameras 9 at the time of robbery. Recording control signals to be given to the monitoring cameras 9 are transmitted to the respective monitoring cameras 9 through the communication processing unit 21 using the LAN. The details of the monitoring camera control process will be described later.

The alarm control section 31 controls the operation of the alarms 10 at the time of robbery. Alarm control signals to be given to the alarms 10 are transmitted to the respective alarms 10 through the communication processing unit 21 using the LAN. The details of the alarm control process will be described later.

A not-shown storing device used for storing data required for execution of the processing by the management server 5 is included in the management server 5. This storing device is constituted by a hard disk or other known various information storing devices.

The database server 8 collectively stores and manages data to be managed in the security system 1, and has a communication processing unit 41, a control unit 42, and an information storing unit 43.

The communication processing unit 41 functions as a communication interface of the database server 8, and conducts processes required for communication with the database server 8 through the LAN. While information is written to and read from the database server 8 through the management server 5 in this embodiment, information may be written and read using other servers and communication terminals instead of the management server 5.

The control unit 42 is a block for carrying out various information processing operations to be executed in the database server 8, and particularly controls processing of writing and reading information to and from the information storing unit 43.

The information storing unit 43 is constituted by an information storing device for storing various information, and has an article information storing section 51, a guard area information storing section 52, and a recording data storing section 53.

The article information storing section 51 stores information about the articles 6 supervised by the security system 1. The guard area information storing section 52 stores information about the monitoring cameras 9 and the alarms 10 disposed within the guard area, information about passages and various facilities within the guard area, and other information. The recording data storing section 53 stores data recorded by the monitoring cameras 9. The details of the information stored in the article information storing section 51, the guard area information storing section 52, and the recording data storing section 53 will be described later.

Not-shown display unit for displaying operations and processes and input unit for receiving commands inputted by the operator may be equipped in the database server 8.

While the management server 5 and the database server 8 are provided as separate devices in this embodiment, the management server 5 may involve the function of the database server 8. In this case, the information storing unit 43 is included in the management server 5, and the database control section 33 directly controls the information storing unit 43.

(Example of Guard Area)

An example of the guard area in the security system 1 in this embodiment is now discussed with reference to FIG. 4. The guard area is an area to be guarded, and the reader/writer 4 can communicate with the RFID tags 2 disposed within the guard area. In other words, the guard area corresponds to an area where the reader/writer 4 can communicate with the RFID tags 2.

A designated area is determined within the guard area. The designated area corresponds to the internal region of the store, for example, and the articles 6 as commodities are allowed to be moved without permission. Thus, when the articles 6 as commodities are moved out of the designated area without permission, it is considered that robbery has occurred.

Figure 4:
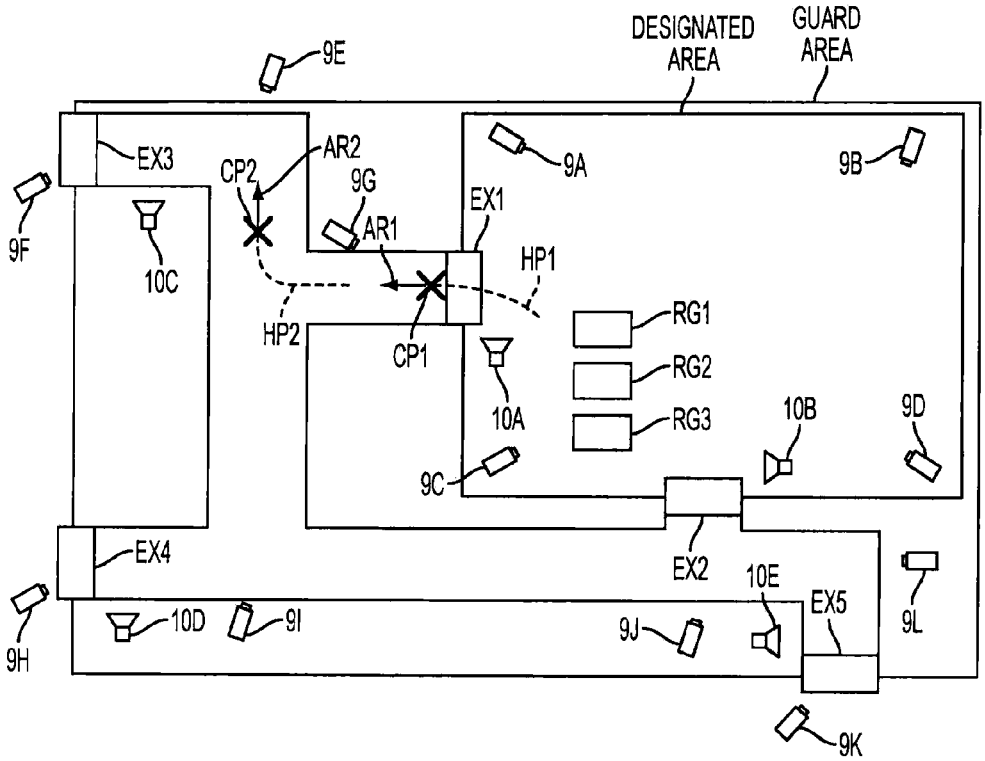
FIG. 4 shows a specific example of a guard area.

According to the example shown in FIG. 4, the entire one floor in a building is the guard area, and a store area occupying a part of that floor is determined as the designated area, for example. The designated area has two exits EX1 and EX2, and the guard area has three exits EX3, EX4 and EX5. The exits EX1 and EX2 are connected with the exits EX3, EX4 and EX5 through a passage.

Monitoring cameras 9A through 9D and alarms 10A and 10B are equipped within the designated area. Monitoring cameras 9E through 9L and alarms 10C through 10E are provided in the area out of the designated area and within the guard area. The monitoring cameras 9A through 9D are chiefly used for monitoring the conditions within the store. The monitoring cameras 9E through 9L out of the designated area are used for recording the robber along the escape route at the time of robbery.

Checkout counters RG 1 through RG3 are provided within the designated area. When a customer pay for any of the articles 6 at any of the checkout counters RG1 through RG3, a shop assistant removes the RFID tag 2 from the corresponding article 6 for which the customer has paid or carries out the process for writing paid-flag to the RFID tag 2. By this step, security is removed from the article 6 after payment.

Though not shown in FIG. 4, the antenna 3 is disposed in such a position as to communicate with the RFID tags 2 provided within the guard area. A plurality of the antennas 3 may be equipped within the guard area as necessary. Also, the antenna 3 may be disposed in the vicinity of the monitoring cameras 9 or the exits EX, for example.

The information on the conditions within the guard area is stored in the guard area information storing section 52. More specifically, the information on the positions of the respective monitoring cameras 9 and the positions of the respective alarms 10 disposed within the guard area, the information on the location of the designated area, the positions of the exits, the positions of the passages, or other information are stored in the guard area information storing section 52. Moreover, the information about the recording capabilities of the respective monitoring cameras 9 is stored in the guard area information storing section 52. The information on the recording capabilities includes panning range information, zoom range information, and other information.

While the guard area is one successive space in the example shown in FIG. 4, the guard area may be a plurality of spaces separated from one another. For example, it is possible that the guard areas are separately located on a plurality of floors.

(Details of Article Information Storing Section)

Information stored in the article information storing section 51 is now explained. FIG. 5 shows an example of information stored in the article information storing section 51. As shown in this figure, the items of the information stored in the article information storing section 51 involve ID information on each RFID tag 2, article name information on the corresponding article 6, robbery occurrence flag indicating that the corresponding article has been stolen, current position information on the corresponding RFID tag 2, and information on the position of the corresponding RFID tag a predetermined time before as position time-sequential record information on the corresponding RFID tag 2.

The ID information shows ID information given to each of the RFID tags 2. The article name information shows the names of the articles 6 associated with the RFID tags 2. These ID information and article name information are included in information to be read from the RFID tags 2.

The current position information indicates the current positions of the corresponding articles 6. In the example shown in the figure, information on the two-dimensional coordinates in the guard area is stored as the current position information. The current position information is not limited to the two-dimensional coordinate information, but may be other position information as long as the current position of the corresponding article is recognizable from the information. For example, the guard area may be divided into a plurality of blocks and the block number may be recorded as the current position information. Three-dimensional coordinate information may be used if necessary.

The information on the position a predetermined time before shows the past position information on the corresponding articles 6. In the example shown in the figure, position information is obtained at intervals of 50 msec., such as 50 msec. before, 100 msec. before, and 150 msec. before. According to this example, therefore, the current position information on the respective RFID tags 2 is acquired at intervals of 50 msec., and this information is stored in the article information storing section 51 as a time-sequential record. A predetermined range of the past position information is stored, and the position information before this range is sequentially deleted.

The robbery occurrence flag shows that the corresponding article 6 has been stolen. According to the robbery occurrence flag, flag "1" is up when the current position information of the corresponding article 6 is moved out of the designated area. In the example shown in the figure, the robbery occurrence flag is up showing that the article 6 having the ID "0002" and the article name "bbb" has been stolen.

Information other than the above information necessary for management of the articles 6 may be stored in the article information storing section 51. For example, manufacture date information, delivery date information, display start date information, display case information, information on the date by which the articles 6 should be used or eaten, or other information may be stored.

(Flow of Guard Process)

The flow of the guard process executed by the security system 1 in this embodiment is now explained with reference to a flowchart shown in FIG. 6.

When the operation of the security system 1 is started, the management server 5 initially obtains the current position information on the respective RFID tags 2 in step 1 (hereinafter abbreviated as S1). More specifically, the reader/writer 4 communicates with the RFID tags 2 disposed within the area of communication range at predetermined intervals under the control of the communication control unit 13. Then, the positioning unit 14 of the reader/writer 4 measures the positions of the respective RFID tags 2 based on the reception signals from the RFID tags 2, and the results of position measurement are sent to the management server 5 through the external communication unit 15. Thus, the management server 5 obtains the current position information on the respective articles 6 associated with the RFID tags 2.

When the communication processing unit 21 of the management server 5 receives the current position information on the respective RFID tags 2 from the reader/writer 4, this information is transmitted to the database control section 33. The database control section 33 having received the current position information on the RFID tags 2 stores this information in the article information storing section 51 of the information storing unit 43 in the database server 8 (S2). More specifically, the database control section 33 transmits the current position information on the respective RFID tags 2 to the database server 8 through the communication processing unit 21. In the database server 8, the control unit 42 receives the current position information on the respective RFID tags 2 through the communication processing unit 41, and stores this information in the article information storing section 51 of the information storing unit 43.

Then, the position determining section 35 obtains the current position information on the respective articles 6 stored in the article information storing section 51, and the designation area information stored in the guard area information storing section 52. Subsequently, the position determining section 35 determines whether any of the articles 6 is located out of the designated area (S3). When NO in S3, i.e., it is determined no article 6 is located out of the designated area, the flow goes to S5.

When YES in S3, i.e., any of the articles 6 located out of the designated area is detected, it is determined that this article 6 has been stolen. In this case, the position determining section 35 commands the article information storing section 51 to raise the robbery occurrence flag for this article 6. Thereafter, the process at the time of robbery is executed in S4. The process at the time of robbery includes the monitoring camera control process for controlling the operation of the monitoring cameras 9, and the alarm control process for controlling the operation of the alarms 10. The details of the monitoring camera control process and the alarm control process will be described later. In the process to be executed at the time of robbery, both the monitoring camera control process and the alarm control process may be performed, or only either of these may be conducted. The process to be executed at the time of robbery may include other processes such as reporting to the police or to the security company.

Then, the operation end command given to the security system 1 is checked. When it is judged that the operation end command has not been given, the steps from S1 are repeated. When it is judged that the operation end command has been given, the operation of the security system 1 ends. The operation end command may be inputted by the operator through the input unit 24 of the management server 5, for example.

(Monitoring Camera Control Process)

Figure 7:
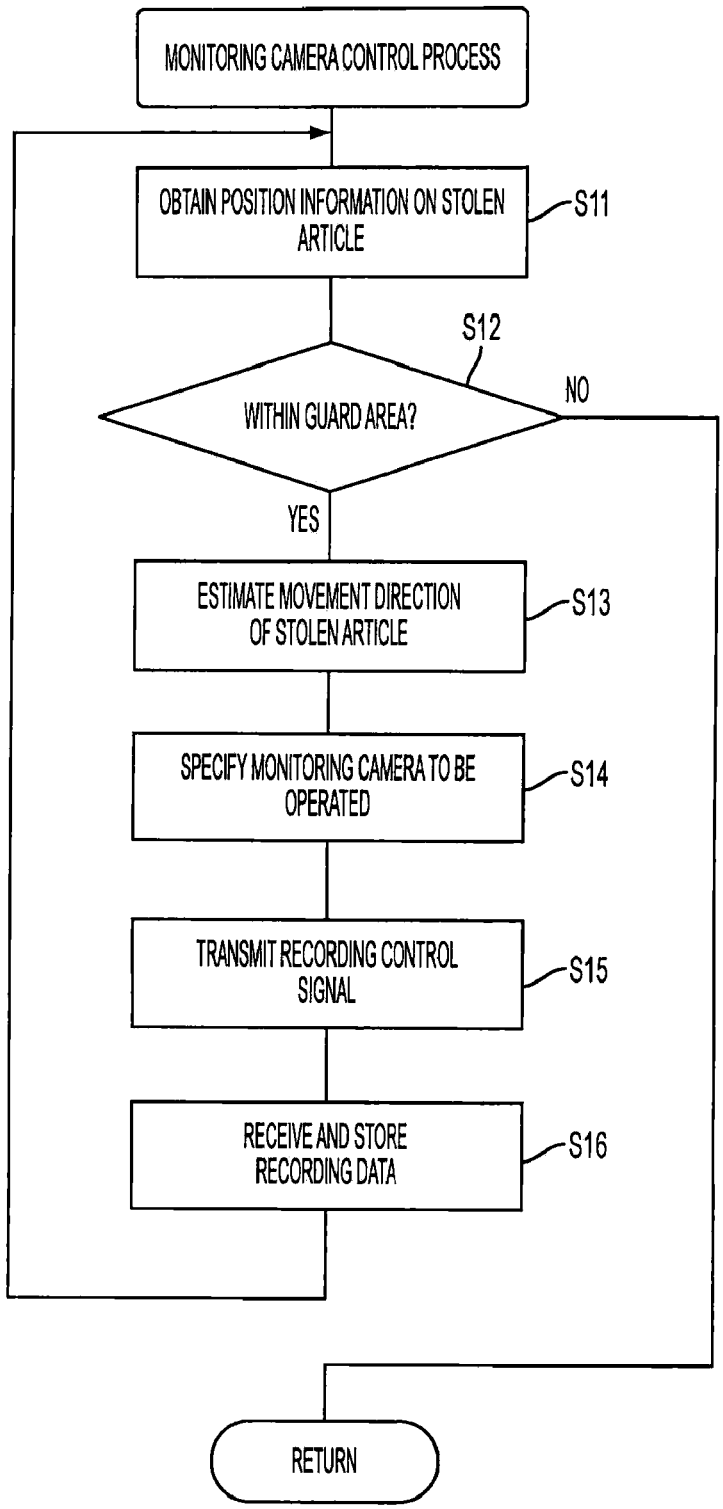
FIG. 7 is a flowchart showing a flow of a monitoring camera control process.

The monitoring camera control process as one of the processes performed at the time of robbery is now explained with reference to a flowchart shown in FIG. 7. When robbery of the article 6 is detected by the position determining section 35, this information is transmitted to the guard process control section 34. The guard process control section 34 having been informed of the robbery of the article 6 commands the monitoring camera control section 32 to start control of the monitoring cameras 9.

The monitoring camera control section 32 having received the command for starting control of the monitoring cameras 9 from the guard process control section 34 initially accesses the information storing unit 43 through the database control section 33, and obtains the current position information and the position information a predetermined time before on the article 6 associated with the raised robbery occurrence flag from the article information storing section 51 (S11).

In S12, it is determined whether the current position based on the obtained information is within the guard area. When it is determined that the position is out of the guard area (NO in S12), the monitoring camera control process ends since the monitoring cameras 9 cannot record the image of the article 6. When the article 6 is located out of the guard area, it is possible that communication from the corresponding RFID tag 2 cannot be received. In this case, the process in S12 is also the step for detecting failure of acquisition of the current position information in S11.

When it is determined that the article 6 is located within the guard area (YES in S12), the monitoring camera control section 32 estimates the movement direction of the article 6 based on the current position information and the position information a predetermined time before on the article 6 (S13). The estimation of the movement direction is conducted by the following method. The monitoring camera control section 32 initially accesses the information storing unit 43 through the database control section 33, and obtains the guard area information stored in the guard area information storing section 52. Then, the monitoring camera control section 32 estimates the movement direction of the stolen article 6 based on the current position information and the position information a predetermined time before on the stolen article 6 and the guard area information.

When the current position obtained based on the current position information is CP1 and the line indicating the time-sequential record based on the position information a predetermined before is HP1 in the example shown in FIG. 4, the estimated movement direction is the direction shown by an arrow AR1 in the figure considering the passage shape information contained in the guard area information. When the robber carrying the article 6 turns at a T-shaped junction and reaches a position CP2 in FIG. 4, the estimated movement direction is the direction shown by an arrow AR2 in the figure considering a line HP2 showing the time-sequential record of the position information and the passage shape.

After estimation of the movement direction of the article 6 in this manner, the monitoring camera control section 32 specifies which monitoring camera 9 should be operated (S14). More specifically, the monitoring camera 9 which should be operated is specified by the following method. Initially, the monitoring cameras 9 disposed in the range of 90 degrees to the left and right from the movement direction of the article 6 are extracted based on the guard area information. While the monitoring cameras 9 equipped within the range of 90 degrees to the left and right from the movement direction of the article 6 are extracted in this example, the angle is not limited to 90 degrees but may be other angles as long as the monitoring cameras 9 positioned before the article 6 in motion can be extracted.

Then, the monitoring cameras 9 are sorted in the order starting from the camera 9 closest to the article 6, and it is judged whether the camera 9 disposed at the closest position to the article 6 can record the image of the article 6. When the camera 9 can record it, this camera 9 is determined as the camera 9 to be operated. If the camera 9 cannot record, it is judged whether the camera 9 disposed at the second closest position to the article 6 can record the image of the article 6. By repeating this step, the monitoring camera 9 to be operated can be determined.

Examples of the case when the camera 9 cannot monitor the article 6 include such cases when the article 6 is positioned in a blind spot due to the shape of the passage, when the distance is so long that recording of effective images cannot be expected, when the article 6 is located out of the panning range of the monitoring camera 9, and other cases. Of these cases, the recording distance range and the panning range are checked based on the recording capability information stored in the guard area information storing section 52.

Though not shown in the flowchart, when it is determined that recording by the monitoring cameras 9 is impossible based on the judgment that none of the monitoring cameras 9 can record the image of the article 6, the flow returns to S11.

When the monitoring camera 9 to be operated is specified, the monitoring camera control section 32 transmits recording control signals to the specified monitoring camera 9 through the communication processing unit 21 using the LAN (S15). Recording is controlled by the following method. Initially, the recording direction and the zoom distance of the monitoring camera 9 are calculated based on the relative positional relationship between the article 6 and the monitoring camera 9. The panning volume and zoom volume of the monitoring camera 9 are controlled such that the recording direction and zoom distance become the calculated values, and the recording control signals are produced based on the calculated panning and zoom controls.

When the monitoring camera 9 receives the recording control signals thus produced, the monitoring camera 9 starts recording in accordance with the recording control signals. When the communication processing unit 21 receives recording data from the monitoring camera 9 through the LAN, the monitoring camera control section 32 gives a command for storing the recording data in the recoding data storing section 53 in the information recording unit 43 of the database server 8 (S16). The control unit 42 of the database server 8 stores the received recording data in the recording data storing section 53 together with at least any one of the information on the name of the stolen article, the RIFD tag 2 information, the recording date information, and the recording spot information. Thus, the recording data of the robber carrying the stolen article 6 and escaping and the information about the robbery can be stored. The recording data may be either of motion picture type or still picture type. Then, the flow returns to S11.

According to these steps, the monitoring camera 9 to be operated is specified based on the position of the stolen article 6 before starting recording. Thus, the robber carrying the article 6 and escaping can be accurately recorded. Moreover, since the movement direction of the stolen article 6 is estimated so that the monitoring camera 9 located before the article 6 in motion can record the image of the article 6, a recording image as viewed substantially from the front of the robber carrying the article 6 can be obtained. It is therefore possible to provide recording images from which the accurate facial features or the like of the robber can be recognized. Furthermore, since the recording direction and zoom distance of the monitoring camera 9 is controlled based on the current position of the article 6, recording images containing the image of the robbery in appropriate size almost at the center of the recording images can be obtained, for example.

According to these steps, the monitoring camera 9 continues recording as long as the article 6 is located within the guard area. Thus, when one of plural robbers brings the article 6 and runs away and another robber receives it and escapes, images of all the robbers can be recorded. Accordingly, image evidences for all the robbers can be offered.

According to these steps, when it is determined that the article 6 is located out of the guard area in S12, the monitoring camera control process ends. However, when the robber having once left the guard area again enters the guard area in the condition where the plural guard areas are located in spaces separated from one another, these steps are effective. More specifically, while the monitoring camera control process temporarily ends at the time when the robber once leaves the guard area, the article 6 carried by the robber is again detected in S3 shown in FIG. 6 when the robber again enters the guard area. In this case, the monitoring camera control process is again executed as the process at the time of robbery. Thus, when the robber detected at the second floor goes out of the guard area in the escape route from the second floor to the first floor in the condition where the guard area is divided into plural areas on the plural floors, the robber can be again detected on the first floor.

(Alarm Control Process)

Figure 8:
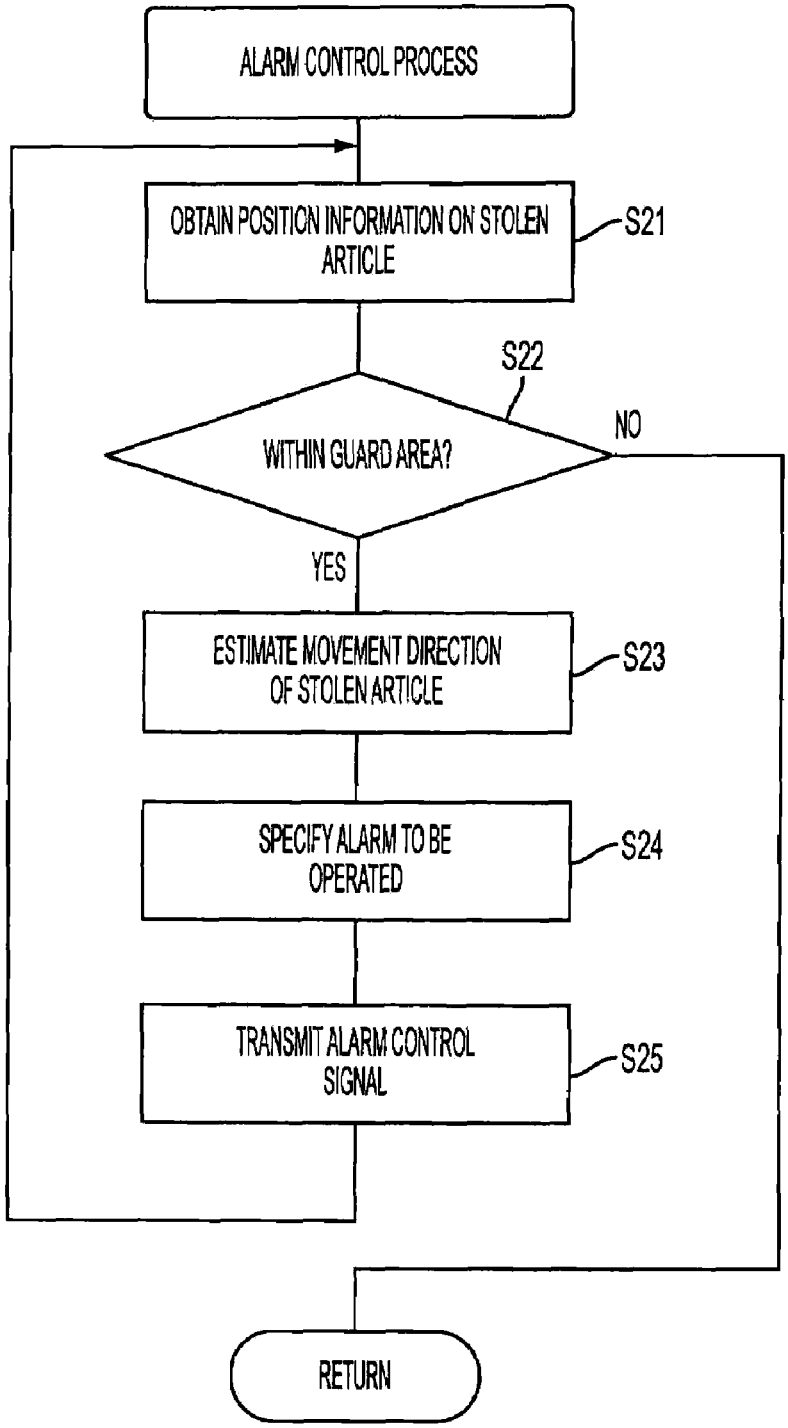
FIG. 8 is a flowchart showing a flow of an alarm control process.

The alarm control process as one of the processes performed at the time of robbery is now explained with reference to a flowchart shown in FIG. 8. When robbery of the article 6 is detected by the position determining section 35, this information is transmitted to the guard process control section 34. The guard process control section 34 having been informed of the robbery of the article 6 commands the alarm control section 31 to start control of the alarms 10.

The alarm control section 31 having received the command for starting control of the alarms 10 from the guard process control section 34 initially accesses the information storing unit 43 through the database control section 33, and obtains the current position information and the position information a predetermined time before on the article 6 associated with the raised robbery occurrence flag from the article information storing section 51 (S21).

In S22, it is determined whether the current position based on the obtained information is within the guard area. When it is determined that the position is out of the guard area (NO in S22), the alarm control processing ends since the alarm operation by the alarms 10 is unnecessary. When the article 6 is located out of the guard area, it is possible that communication from the corresponding RFID tag 2 cannot be received. In this case, the process in S22 is also the step for detecting failure of acquisition of the current position information in S21.

When it is determined that the article 6 is located within the guard area (YES in S22), the alarm control section 31 estimates the movement direction of the article 6 based on the current position information and the position information a predetermined time before on the article 6 (S23). The estimation of the movement direction is conducted by the method similar to that in S13 shown in FIG. 7, and thus explanation on this method is not repeated herein.

After estimation of the movement direction of the article 6 in this manner, the alarm control section 31 specifies which alarm 10 should be operated (S24). More specifically, the alarm 10 which should be operated is specified by the following method. Initially, the escape route is estimated based on the movement direction of the article 6 and the guard area information. Then, the alarm 10 disposed along the estimated route is specified. When a plurality of escape routes are estimated, the alarms 10 disposed along all the escape routes may be specified.

When the alarm 10 to be operated is specified, the alarm control section 31 transmits alarm control signals to the specified alarm 10 through the communication processing unit 21 using the LAN (S25). In this case, appropriate alarm control signals are selected in accordance with the function of the alarm 10. For example, when the alarm 10 is a voice emitting device which emits alarm sounds or alarm voices, the alarm control signals contain control over alarm sound emission, alarm voice type control, or other controls. When the alarm 10 is a display device which displays information or images about the warning, the alarm control signals contain transmission of information or image data to be displayed. When the alarm 10 receives these alarm control signals, the alarm 10 starts alarm operation in accordance with the alarm control signals. Thereafter, the flow returns to S21.

According to these steps, the alarm 10 to be operated is specified based on the position of the stolen article 6 before starting alarm operation. Thus, accurate alarming to the robber carrying the article 6 and escaping can be effected. Moreover, since the movement direction of the stolen article 6 is estimated so that the alarm 10 located along the estimated escape route can emit alarm sounds, only a minimum number of the alarms 10 are required to be operated. As a result, meaningless alarming in other areas can be avoided.

Alternatively, the behavior of the person who tries to carry the article 6 before payment and leave the designated area may be estimated based on the position, moving direction and moving speed of the article 6, and display or voice instructions for asking payment at the checkout counter may be produced from an alarm equipped in the vicinity of the exit immediately before the person goes out of the designated area. In this case, guidance showing the position of the closest checkout counter or of the checkout counter having the shortest waiting line in the plural checkout counters may be given.

(Other Examples of Management Server and Database Server)

Figure 9:
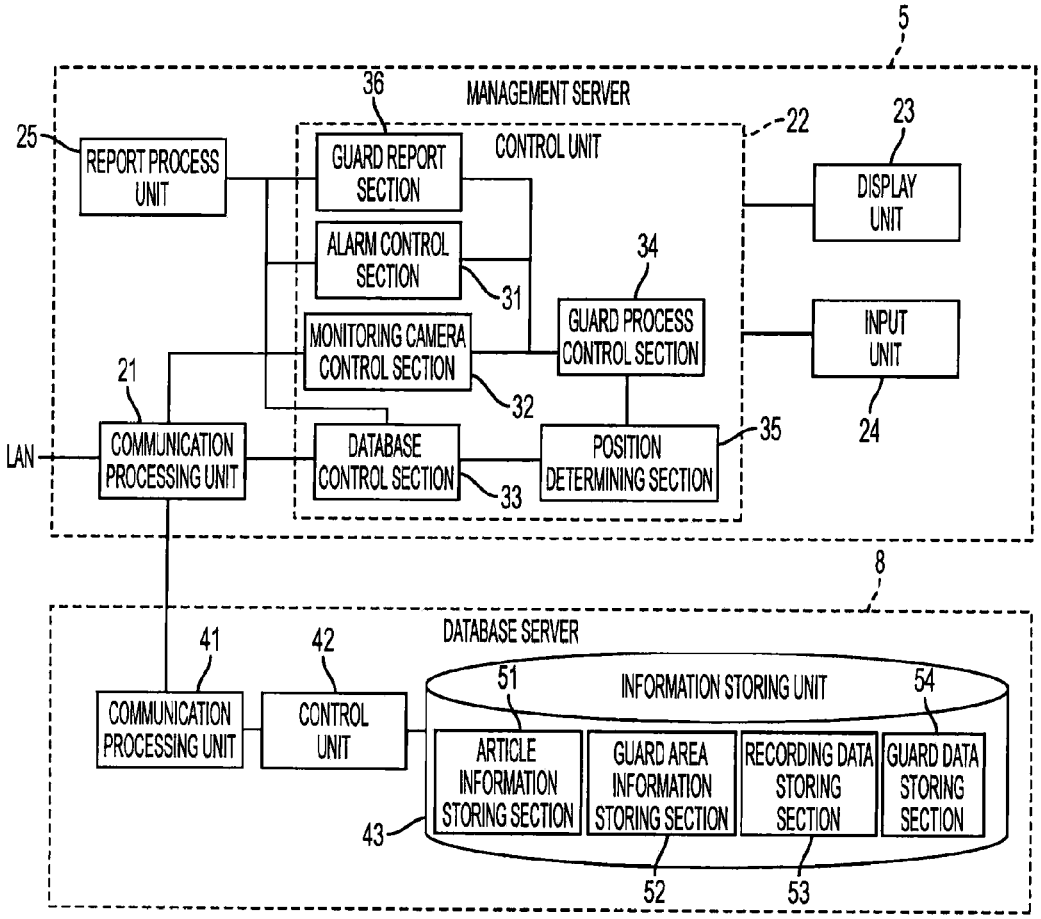
FIG. 9 is a block diagram schematically showing structures of a management server and a database server for reporting to a guard.

Next, a system which can report occurrence of robbery to the guards is discussed. FIG. 9 shows structures of the management server 5 and the database server 8 in this example.

Figure 1:
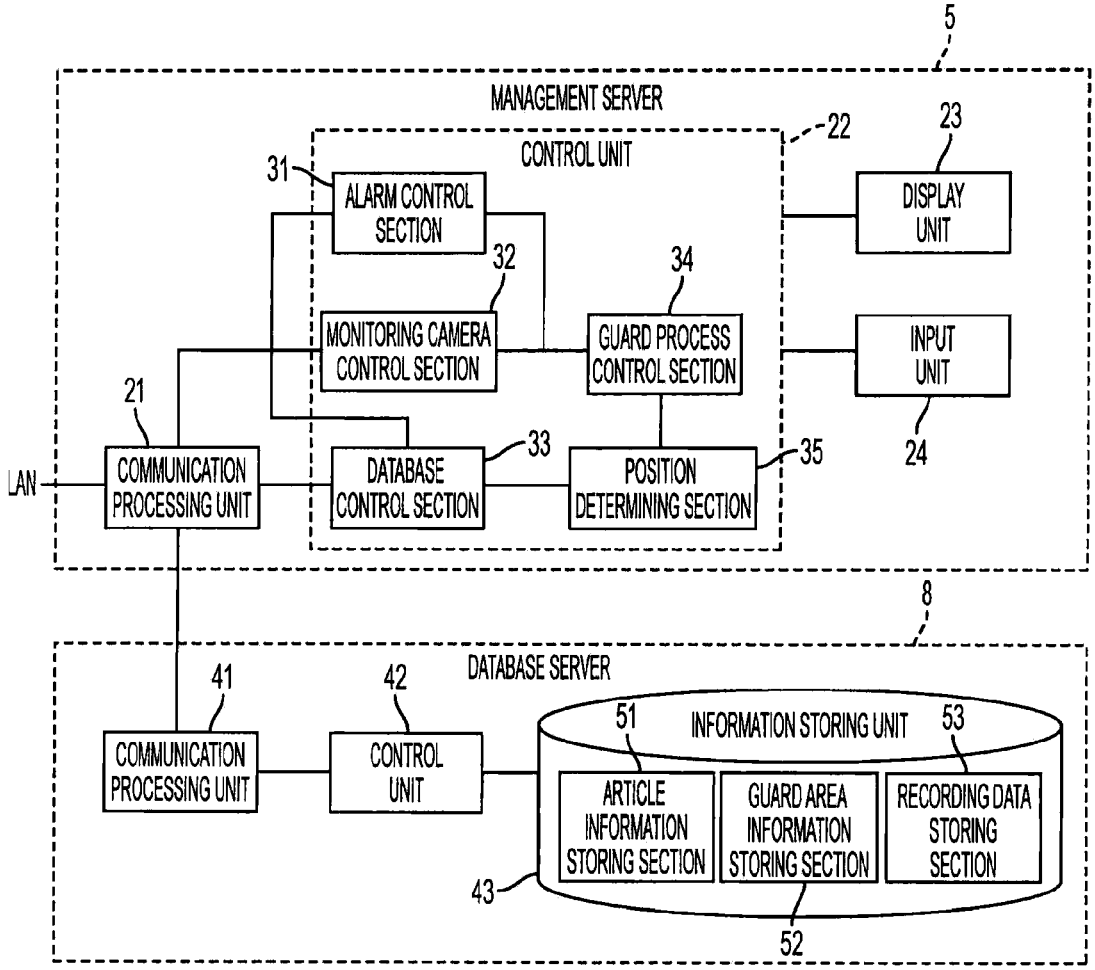
FIG. 1 is a block diagram schematically showing structures of a management server and a database server included in a security system in an embodiment according to the invention.

According to the structure shown in the figure, the differences between the structures shown herein and in FIG. 1 are as follows. The management server 5 in this example further contains a report process unit 25, and a guard report section 36 is further added to the control unit 22. In the database server 8, a guard data storing section 54 is further added to the information storing unit 43. Other parts in this example are similar to the corresponding parts in the structure shown in FIG. 1, and thus explanation of those is not repeated herein.

When the guard report section 36 receives operation start commands from the guard process control section 34 which has detected occurrence of robbery, the guard report section 36 controls the process for reporting the information on the position of the stolen article 6 or the like as the process at the time of robbery. The report process unit 25 conducts process for reporting to cellular terminals carried by the guards based on the commands from the guard report section 36. The details of the guard report process will be described later.

The guard data storing section 54 stores information on the cellular terminals carried by the respective guards. Examples contained in this information include telephone numbers and mail addresses if the cellular terminals are cellular phones, but other information may be included as long as it specifies any of the cellular terminals to which report is given.

(Guard Report Process)

Figure 10:
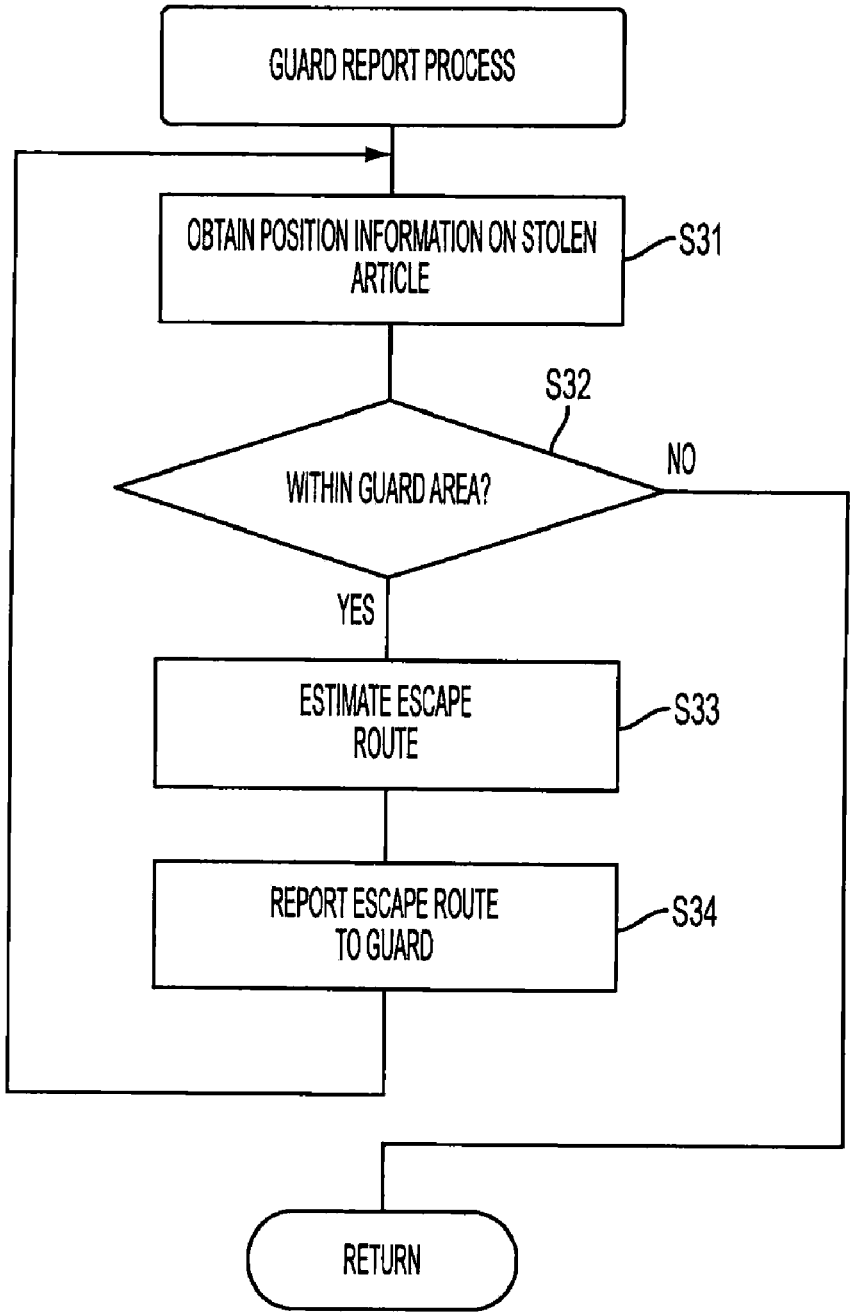
FIG. 10 is a flowchart showing a flow of a guard report process.

The guard report process as one of the processes performed at the time of robbery in the structure shown in FIG. 9 is now explained with reference to a flowchart shown in FIG. 10. When robbery of the article 6 is detected by the position determining section 35, this information is transmitted to the guard process control section 34. The guard process control section 34 having been informed of the robbery of the article 6 commands the guard report section 36 to start the guard report process.

The guard report section 36 having received the command for starting the guard report process from the guard process control section 34 initially accesses the information storing unit 43 through the database control section 33, and obtains the current position information and the position information a predetermined time before on the article 6 associated with the raised robbery occurrence flag from the article information storing section 51 (S31).

In S32, it is determined whether the current position based on the obtained information is within the guard area. When it is determined that the position is out of the guard area (NO in S32), the guard report process ends since the guard report process is unnecessary. When the article 6 is located out of the guard area, it is possible that communication from the corresponding RFID tag 2 cannot be received. In this case, the process in S32 is also the step for detecting failure of acquisition of the current position information in S31.

When it is determined that the article 6 is located within the guard area (YES in S32), the guard report section 36 estimates the movement direction of the article 6 based on the current position information and the position information a predetermined time before on the article 6. The estimation of the movement direction is conducted by the method similar to that in S13 shown in FIG. 7, and thus explanation on this method is not repeated herein. After estimation of the movement direction of the article 6 in this manner, the guard report section 36 estimates the escape route based on the movement direction of the article 6 and the guard area information (S33).

Then, the guard report section 36 reads contact data used for contacting the guards from the guard data storing section 54 of the information storing unit 43, and commands the report process unit 25 to report the estimated escape route information to the respective guards. The report process unit 25 transmits the escape route information to the cellular terminals such as the cellular phones carried by the respective guards in accordance with this command (S34). Thereafter, the flow returns to S31.

The report process unit 25 may provide the escape route information by calling the cellular terminals carried by the guards using synthetic voices or the like, or using e-mail. In case of e-mail, images of the robber's face and the stolen article, and figure data showing the current position of the robber or the estimated escape route or exit may be transmitted as attached data.

Other radio communication media may be used to report the escape route information to the cellular terminals carried by the guards.

According to the above steps, the escape route of the robber is determined based on the position of the stolen article 6 and this escape route information is given to the guards. Thus, the probability of catching the robber by the guards can be increased.

It is possible to obtain the information on the current positions of the respective guards by letting the respective guards carry the RFID tags 2 so that the escape route information is given to only the guard closest to the robber. While the escape route information is given to the respective guards in this example, only the position information of the stolen article 6 may be offered.

(Recording Process of Image Recorded at Robbery)

When a plurality of the monitoring cameras 9 are equipped within the designated area as in the example shown in FIG. 4, images at the time of robbery can be recorded by the following method.

It is basically assumed that the plural monitoring cameras 9 disposed within the designated area are constantly recording. The recording data is continuously stored in the recording data storing section 53 of the information storing unit 43. The recording data is sequentially deleted after elapse of a predetermined time so that the storage capacity of the information storing unit 43 can be secured.

Figure 6:
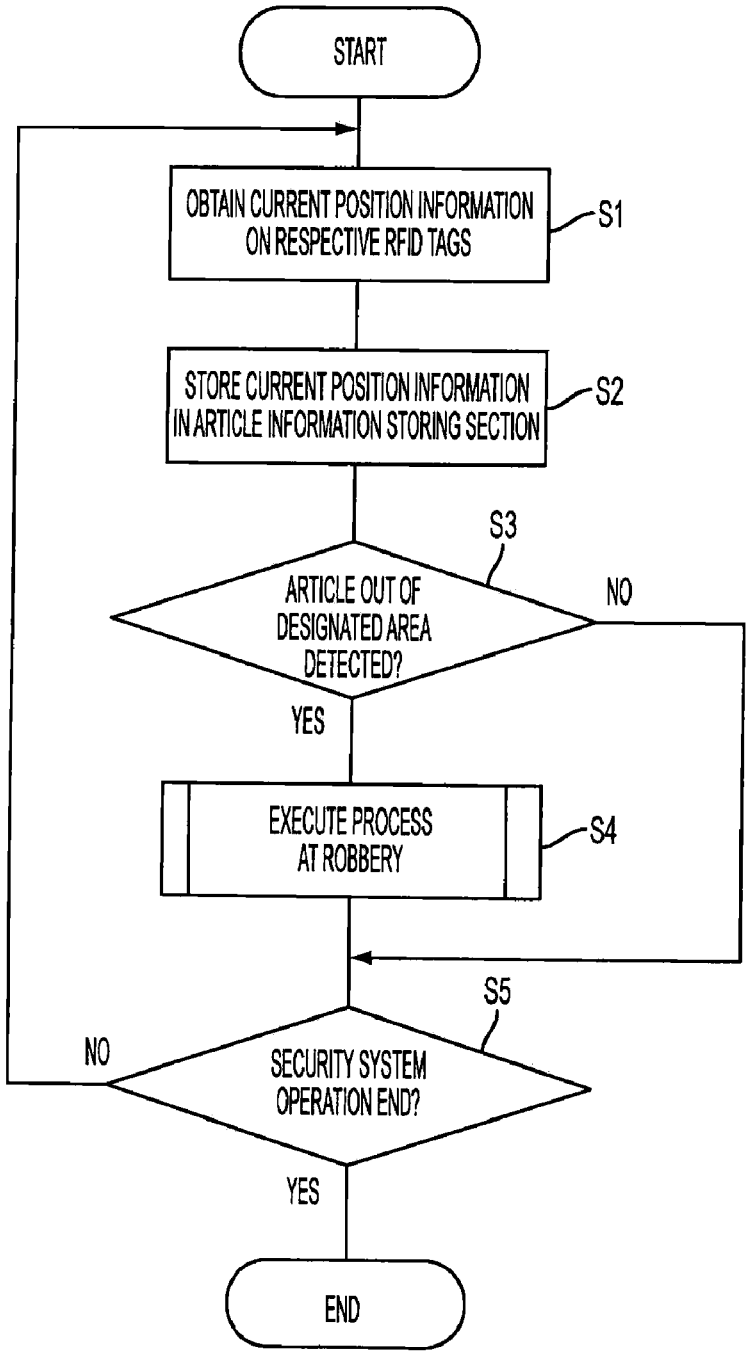
FIG. 6 is a flowchart showing a flow of a guard process.

When robbery is detected in S3 shown in FIG. 6, the database control section 33 is notified of this detection. The database control section 33 having received the robbery detection notification commands the database server 8 to store the recording data obtained a predetermined time before the robbery detection (e.g., 30 seconds before the detection) up to the time of the robbery detection. Thus, the recording data at the very moment when the robber steals the article 6 can be obtained without fail. The recording data recorded at the time of robbery may be stored in the recording data storing section 53 together with at least any one of the information on the name of the stolen article, the RIFD tag 2 information, the recording date information, and the recording spot information. In this case, the recording data recorded at the time of robbery can be recorded while associated with the information on the robbery.

(Another Example of Recording Process of Image Recorded at Robbery)

Figure 11:
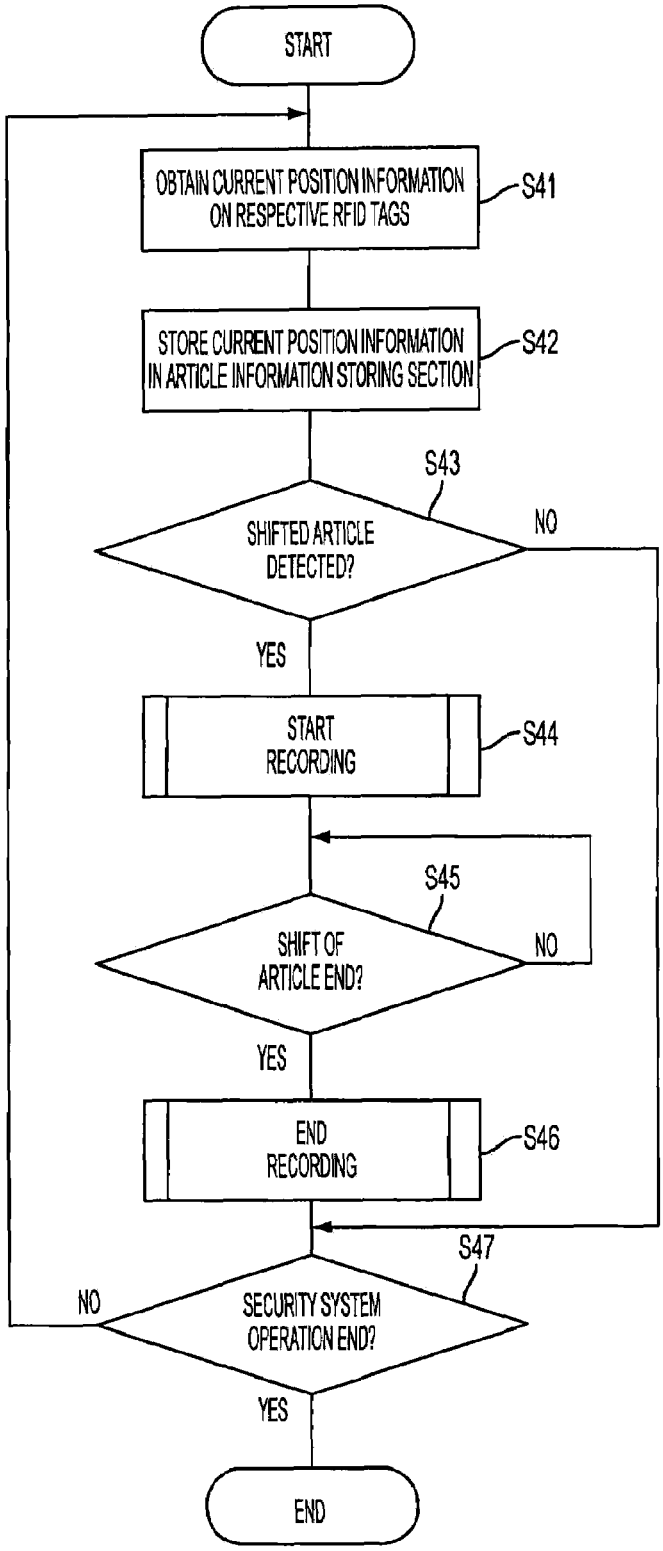
FIG. 11 is a flowchart showing a flow of a recording process at robbery.

The recording start of the monitoring cameras 9 disposed within the designated area may be controlled in the following manner. FIG. 11 is a flowchart showing recording processing executed at the time of robbery. This recording process at the time of robbery is performed simultaneously with the guard process shown in FIG. 6.

Initially, the management server 5 obtains the current position information on the respective RFID tangs 2. More specifically, the reader/writer 4 communicates with the respective RFID tags 2 located within the area of communication range at predetermined intervals under the control of the communication control unit 13. Then, the positioning unit 14 of the reader/writer 4 measures the positions of the respective RFID tags 2 based on the reception signals from the RFID tags 2, and the external communication unit 15 transmits the results of the position measurement to the management server 5. Thus, the management server 5 obtains the current position information on the respective articles 6 associated with the RFID tags 2.

When the communication processing unit 21 of the management server 5 receives the current position information on the respective RFID tags 2 from the reader/writer 4, the communication processing unit 21 transmits this information to the database control section 33. The database control section 33 having received the current position information on the respective RFID tags 2 commands the article information storing section 51 in the information storing unit 43 of the database server 8 to store the current position information on the RFID tags 2 (S42).

Then, the position determining section 35 obtains the current position information and the position information a predetermined time before on the respective articles 6 stored in the article information storing section 51. Thereafter, the position determining section 35 judges whether the position of any of the articles 6 has been shifted (S43). When NO in S43, i.e., when it is determined that no article 6 has been shifted, the flow goes to S47.

When YES in S43, i.e., when it is determined that the position of any of the articles 6 has been shifted, the recording process starts from S44. More specifically, the positions of the articles 6 do not basically change when they are displayed on the show case. It is thus considered that the position of the article 6 changes on such occasions when the customer takes the article 6 in his or her hand for purchase, when the shop assistant changes the position of the article 6, and when the article 6 is stolen. Therefore, even though recording starts on occasions other than robbery, the image at the very moment of robbery can be recorded.

The recording process herein is conducted under the recording control of the monitoring camera control section 32 (panning control, zoom control, or other control) such that the image of the article 6 can be recorded based on the position information on the article 6 which has been shifted. Since the appropriate image at the very moment of robbery is recorded, an effective recording image as evidence showing the condition of robbery can be offered. The recording data is stored in the recording data storing section 53 of the information storing unit 43.

When it is confirmed that the movement of the article 6 has been stopped in S45, recording is stopped in S46. Thereafter, it is checked whether the command for ending operation of the security system 1 has been given in S47. When it is determined that the operation end command has not been given, the steps from S41 are repeated. When it is determined that the operation end command has been given, the operation of the security system 1 ends.

As apparent from above, the data recorded in S44 contains a number of data showing images not related to robbery. Thus, such recording data is sequentially deleted after elapse of a predetermined time so that the storage capacity of the information storing unit 43 can be secured and that no information or image of customers not concerned with robbery is left in view of personal information protection.

When it is confirmed that robbery has actually occurred in the guard process shown in FIG. 6, the recording data related to the robbery is extracted from the temporarily stored recording data, and used as evidence data.

While recording starts when the position of the article 6 is changed in this example, the management server 5 also may receive information on the intensity of radio waves from the respective RFID tags 2 through the reader/writer 4 so that recording can start when the intensity of radio waves change. For example, in case of plural robbers, it is possible that the robbery target article 6 is surrounded by the plural persons so as to conceal the situation of robbery from others around. In this case, the intensity of radio waves varies, and at this moment recording can start.

(Facial Recognition from Recorded Image)

A structure for detecting a suspicious person in advance based on the recording data stored in the recording data storing section 53 is now discussed. For example, it is assumed herein that there is a person who did not steal any article but exhibited suspicious behavior. In this case, the recording data of the suspicious person can be stored by starting record at the time when the position change of the article 6 is detected in the manner described above. For example, the recording data of the suspicious person is separately stored in the recording data storing section 53 as suspicious person recording data in accordance with the command by the operator so that this data is not deleted after elapse of a predetermined time.

The suspicious person recording data is stored in this way, and the monitoring camera 9 is equipped such that the person entering the designated area can be recorded. When it is determined that the person entering the designated area is identical to the suspicious person shown in the suspicious person recording data by checking the entering person data with the suspicious person data and conducting the facial recognition process, this information is given to the guards so as to increase the level of caution against the suspicious person.

Moreover, the following process may be carried out so as to cope with the case when the robber gives up the article 6 or removes the RFID tag 2 from the article 6 to take out only the article 6 while escaping. Initially, the image of the facial part is extracted from the recording image of the robber carrying the article 6 and stored in the recording data storing section 53. Then, the image of the person identical to the image of the facial part is extracted from the images recorded by the monitoring cameras 9 which are constantly recording. This person is recognized as the robber, and the current position information of the robber is obtained. Thus, even in the case of plural robbers, all the robbers can be separately followed.

(Example of RFID Tag Provided with Alarm)

Figure 15:
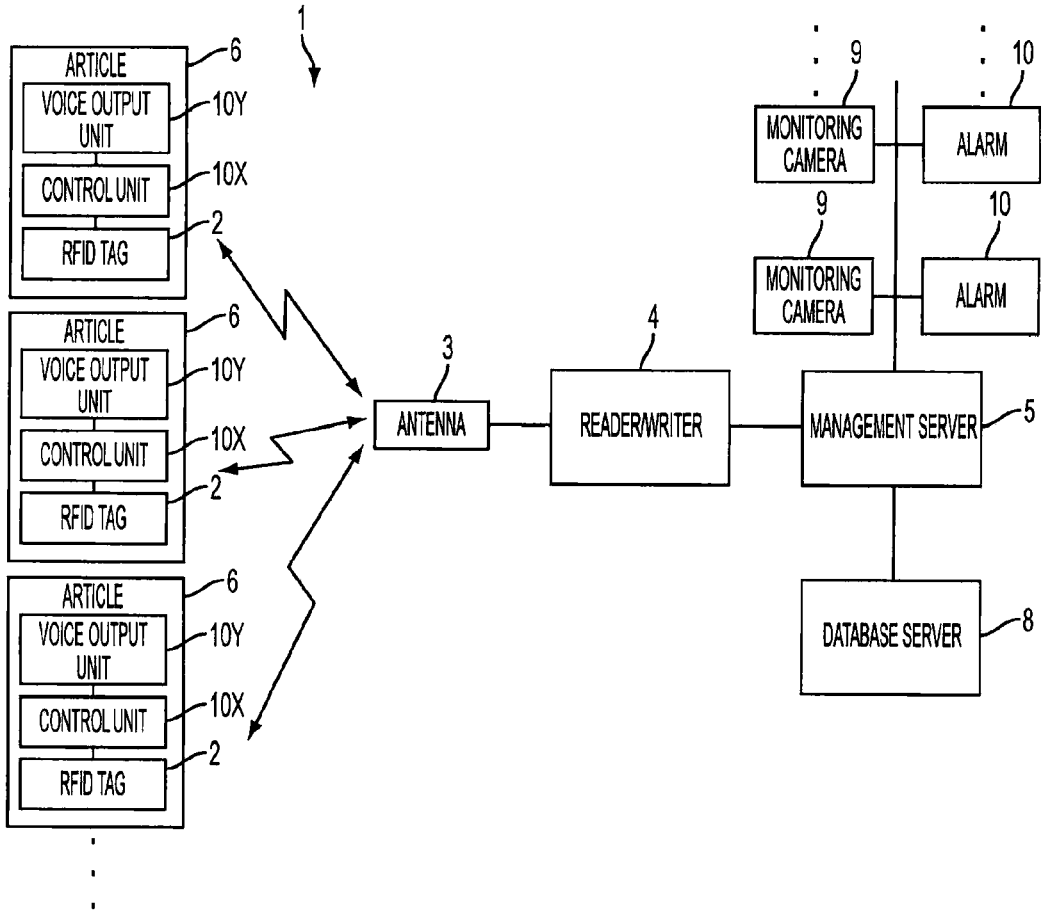
FIG. 15 is a block diagram schematically showing a structure of a security system in which a control unit and a voice output unit as well as an RFID tag are attached to each article.

Next, an example of the RFID tags 2 having the function of the alarm 10 is explained. FIG. 15 shows a structure of the security system 1 where a control unit 10X and a voice output unit 10Y as well as the RFID tag 2 are attached to each of the articles 6. The difference between the structures shown in this figure and FIG. 2 is only the structure of the articles 6, and similar parts are used in other points.

When the voice output command signals are transmitted from the reader/writer 4 to any of the RFID tags 2, the control unit 10X receives the command from the RFID tag 2 and controls the voice output unit 10Y in accordance with the command. The voice output unit 10Y outputs voices in accordance with the command from the control unit 10X, and is constituted by an amplifier, speaker, and other components, for example.

In this structure, the alarm control process explained above is executed by the following method. In the flowchart shown in FIG. 8, the alarms 10 to be operated are specified by the alarm control section 31 in S24. The alarm control section 31 further specifies the alarm 10 attached to the stolen article 6 as the alarm to be operated in this step. In S25, the alarm control section 31 sends signals commanding the RFID tag 2 associated with the stolen article 6 to output voices as alarm control signals to the reader/writer 4 through the communication processing unit 21. The reader/writer 4 gives voice output commands to the corresponding RFID tag 2 using RF signals in accordance with the received command signals. Thus, alarm sounds are outputted by the voice output unit 10Y attached to the article 6.

In this structure, alarm sounds emitted from the stolen article 6 itself can be effective threats to the robber. Since alarm sounds are emitted from the article 6, the robber may give up the article 6 and escape. As a result, prevention of robbery of the article 6 can be enhanced.

(Structure of Distance Measurement)

Figure 12:
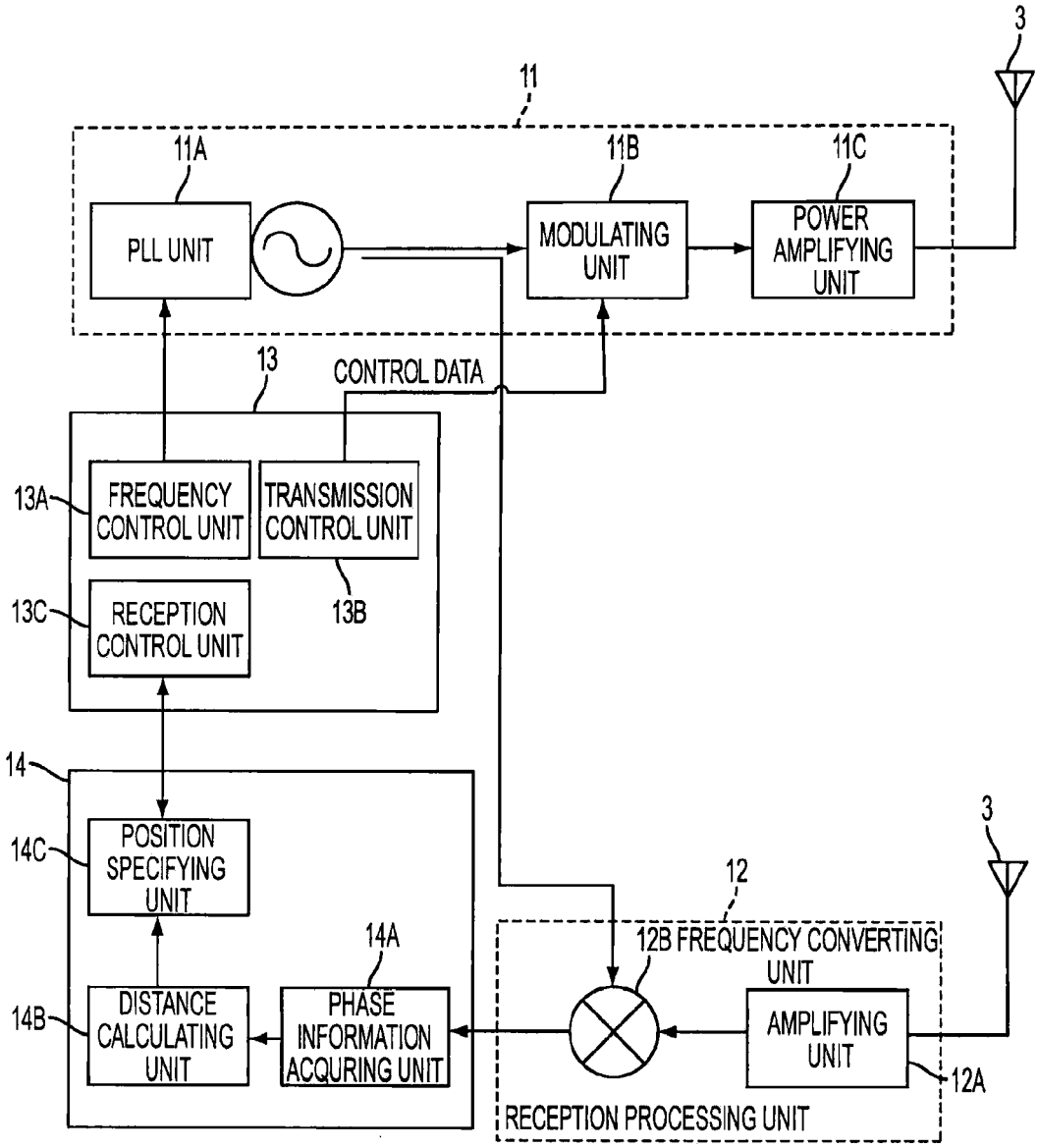
FIG. 12 is a block diagram showing a structure example of a reader/writer.

An example of a structure used for measuring the distance between the target RFID tag 2 and the reader/writer 4 is now explained with reference to FIG. 12. As shown in this figure, the transmission processing unit 11 has a PLL (phase locked loop) unit 11A as a frequency adjusting unit, a modulating unit 11B, and a power amplifying unit 11C. The reception processing unit 12 has an amplifying unit 12A, and a frequency converting unit 12B. The communication control unit 13 has a frequency control unit 13A, a transmission control unit 13B, and a reception control unit 13C. The positioning unit 14 has a phase information acquiring unit 14A, a distance calculating unit 14B, and a position specifying unit 14C.

In the transmission processing unit 11, the PLL unit 11A is a block for establishing the transfer frequency of the transmission signals from the antenna 3, and is constituted by a PLL circuit. The modulating unit 11B modulates transfer signals produced by the PLL unit 11A and superposes data on the transmission signals.

In this embodiment, the modulating unit 11B produces transmission signals by applying ASK (amplitude shift keying) modulation. The modulation method of the transmission signals is not limited to this ASK modulation, but other digital modulation methods such as FSK (frequency shift keying) modulation and PSK (phase shift keying modulation) modulation. The power amplifying unit 11C amplifies the transmission signals.

In the reception processing unit 12, the amplifying unit 12A is a block for amplifying the reception signals received by the antenna 3. The frequency converting unit 12B decreases the frequency of the reception signals amplified by the amplifying unit 12A to a lower frequency.

In the communication control unit 13, the frequency control unit 13A is a block for controlling the frequency of the transfer signals established by the PLL unit 11A. The transmission control unit 13B is a block for inputting data used for modulation of the transmission signals to the modulating unit 11B. The reception control unit 13C is a block for receiving information on the position specified by the position specifying unit 14C.

In the positioning unit 14, the phase information acquiring unit 14A is a block for detecting the phase of the reception signals after frequency conversion by the frequency converting unit 12B and acquiring this information as phase information. The distance calculating unit 14B is a block for calculating the distance between the target RFID tag 2 and the antenna 3 based on the phase information obtained by the phase information acquiring unit 14A.

The position specifying unit 14C specifies the attachment position of the target RFID tag 2 based on the distance calculated by the distance calculating unit 14B. When a plurality of the antennas 3 are equipped, for example, the distance calculating unit 14B calculates the distance between each of the antennas 3 and the RFID tag 2. In this case, the position specifying unit 14C specifies the position of the RFID tag 2 as two-dimensional coordinates (for two distances) or three-dimensional coordinates (for three or more distances) based on the plural distance information. Then, the position specifying unit 14C specifies where the target RFID tag 2 is located within the guard area using the coordinates of the RFID tag 2 thus determined. The position information on the specified RFID tag 2 thus specified is transmitted through the reception control unit 13C to the external communication unit 15, and to the management server 5.

While the coordinates of the RFID tag 2 are specified based on the plural distance information in this example, the coordinates of the RFID tag 2 may be specified by detecting the location direction of the RFID tag 2 as viewed from the antenna 3 as well as the distance information.

While the position specifying unit 14C is provided in the reader/writer 4 in this example, the position specifying unit 14C may be disposed in the management server 5. More specifically, the distance information calculated by the distance calculating unit 14B may be transmitted as it is through the external communication unit 15 to the management server 5, where the position specifying process may be performed by the position specifying unit provided in the management server 5. Additionally, the positioning unit 14 itself may be disposed in the management server 5 rather than in the reader/writer 4.

(Details of Distance Measurement)

An example of a method for calculating distances by the distance calculating unit 14B is now explained with reference to FIGS. 13A through 13C and FIG. 14.

Figure 13A:
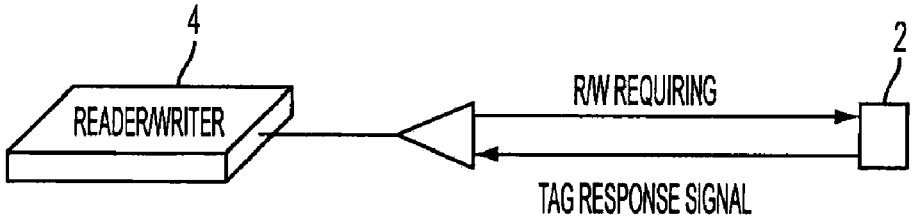
FIG. 13A shows a condition where R/W requiring signals and tag response signals are transmitted and received between the reader/writer and an RFID tag.

In this embodiment, the reader/writer 4 sends R/W requiring signals (requiring signals) to the RFID tag 2, and the RFID tag 2 in turn sends tag response signals to the reader/writer 4. This process is shown in FIG. 13A.

Figure 13B:
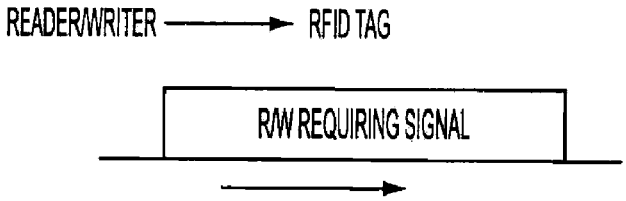
FIG. 13B shows a condition where R/W requiring signals are transmitted.

While constantly sending specific signals, the reader/writer 4 transmits R/W requiring signals requiring the RFID tag 2 to return the tag response signals at the time of requiring transmission of the tag response signals from the RFID tag 2 as illustrated in FIG. 13B.

More specifically, the transmission control unit 13B of the reader/writer 4 commands the modulating unit 11B to transmit data required in the normal condition when in the normal condition, and commands the modulating unit 11B to transmit data constituting the R/W requiring signals when requiring the tag response signals.

The RFID tag 2 constantly monitors signals sent from the reader/writer 4. When the RFID tag 2 detects reception of the R/W requiring signals, the RFID tag 2 sends the tag response signals in response to the R/W requiring signals.

Figure 13C:
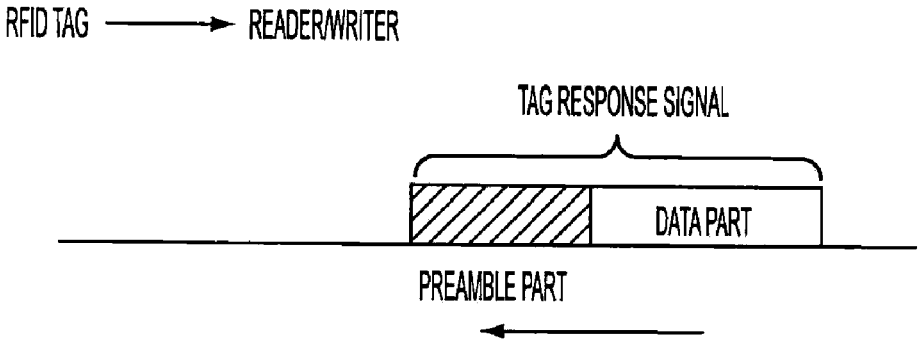
FIG. 13C shows a condition where tag response signals are transmitted.

As illustrated in FIG. 13C, each of the tag response signals is constituted by a preamble part and a data part. The preamble part corresponds data which shows the beginning of the tag response signal and the predetermined data common to all the RFID tag 2 within the same standards (e.g., ISO/IEC 180000-6). The data part is successively transmitted after the preamble part, and shows substantial information sent from the RFID tag 2. The information included in the data part involves ID information on each of the RFID tags 2, for example, but may contain other information which should be transmitted from the RFID tag 2 such as various information stored in the storing section within the RFID tag 2.

Figure 14:
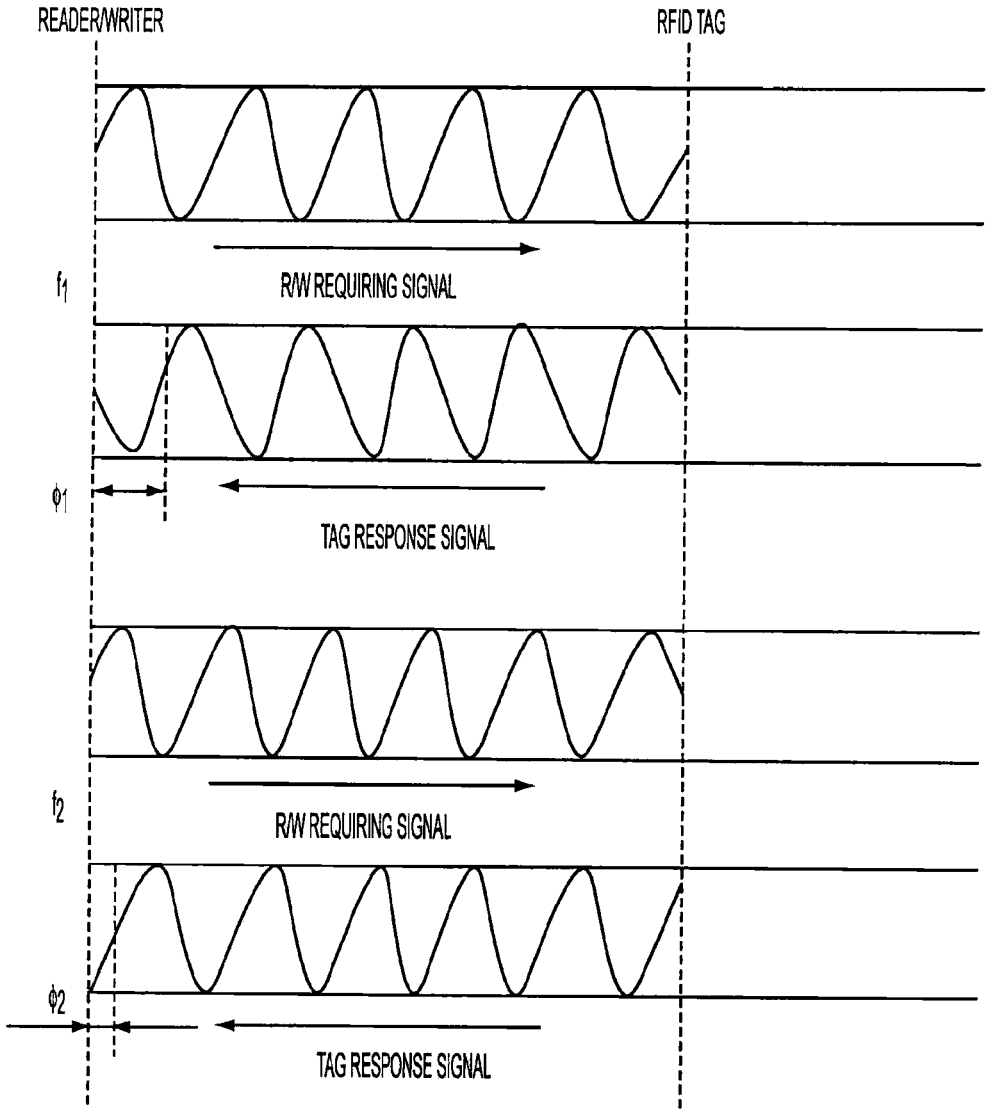
FIG. 14 shows phase variations caused when R/W requiring signals and tag response signals are transmitted and received at two different frequencies.

Then, the reader/writer 4 transmits the R/W requiring signals twice at the transfer frequencies different from each other for the respective transmissions. More specifically, the frequency control unit 13A of the reader/writer 4 commands the PLL unit 11A to output the transfer signals at a first frequency $f_1$ at the time of the first transmission of the R/W requiring signals, and commands the PLL unit 11A to output the transfer signals at a second frequency $f_2$ different from the first frequency $f_1$ at the time of the second transmission of the R/W requiring signals. FIG. 14 shows this process.

As shown in the figure, when the RFID tag 2 receives the R/W requiring signals sent at the first frequency $f_1$, the tag response signals at the same first frequency $f_1$ are returned. Then, the reader/writer 4 analyzes the preamble part of the tag response signals received by the phase information acquiring unit 14A to detect $\phi_1$ showing phase variations of the tag response signals. Similarly, when the RFID tag 2 receives the R/W requiring signals sent at the second frequency $f_2$, the tag response signals at the same second frequency $f_2$ are returned. Then, the reader/writer 4 analyzes the preamble part of the tag response signals received by the phase information acquiring unit 14A to detect $\phi_2$ showing phase variations of the tag response signals.

While the phase variations of the tag response signals are detected by analysis of the preamble part in this example, phase variations of both the preamble part and the data part, or only of the data part may be detected. It is difficult, however, to detect the phase variations in accordance with the distances based on the analysis of the data part whose contents are variable in case of the PSK modulation method. It is thus preferable to detect phase variations based on the preamble part whose contents are fixed.

In this embodiment, the reader/writer 4 detects phase variations for every 50 msec. More specifically, the reader/writer 4 transmits the R/W requiring signals to the RFID tag 2 twice at intervals of 50 msec. The timing of detection of the phase variations is not limited to 50 msec. interval, but may be shorter time intervals or longer time intervals. It is preferable that this timing is appropriately determined according to the moving speed of the article.

In this embodiment, the article information about the article stored in the RFID tag 2 is also obtained at the time of detection of the phase variations. However, the timing for acquiring this article information may be different from the timing for detecting the phase variations.

When the phase information acquiring unit 14A detects the phase variations $\phi_1$ and $\phi_2$, the information on the phase variations is transmitted to the distance calculating unit 14B. The distance calculating unit 14B calculates the distance between the RFID tag 2 and the antenna 3 in the following manner based on the phase variations $\phi_1$ and $\phi_2$.

When the distance from the antenna 3 to the RFID tag 2 is a distance r, the phase variations $\phi_1$ and $\phi_2$ generated when the signals transferred at the first frequency $f_1$ and the second frequency $f_2$ propagates for a distance of 2r for going back and forth are expressed by the following equations:

$$\phi_1 = \frac{2\pi \cdot f_1}{c} \cdot 2r,\ \phi_2 = \frac{2\pi \cdot f_2}{c} \cdot 2r \qquad \text{Equation 1}$$

In these equations, c indicates a speed of light. The distance r is calculated by the following equation based on the above two equations:

$$r = \frac{c \cdot \Delta\phi}{4\pi|f_1 - f_2|} \qquad \text{Equation 2}$$

$$\because \Delta\phi = \phi_1 - \phi_2$$

By these calculations, the distance r from the antenna 3 to the RFID tag 2 can be obtained based on the phase variations $\phi_1$ and $\phi_2$. It is expected that a phase difference is caused during the period from the time when the RFID tag 2 receives the R/W requiring signals till the time when the RFID tag 2 sends the tag response signals. The degree of this phase difference is the same for both the signals transferred at the first frequency $f_1$ and the signals transferred at the second frequency $f_2$. Thus, the phase difference caused when the RFID tag 2 transmits and receives signals does not influence the results of the above distance calculations.

Since the reader/writer 4 sends the R/W requiring signals to the RIFD tag 2 twice at the intervals of 50 msc., the reader/writer 4 can measure the distance between the RFID tag 2 and the reader/writer 4 for every 50 msec.

When $\Delta\phi$ is $2\pi$ or larger in Equation 2, the accurate distance r cannot be calculated. Thus, the maximum value rmax of the distance r which can be measured is obtained when $\Delta\phi=2\pi$, and expressed by the following equation:

$$r\max = \frac{c}{2 \cdot |f_1 - f_2|} \qquad \text{Equation 3}$$

When the difference between the first frequency $f_1$ and the second frequency $f_2$ is 5 MHz, for example, the maximum distance rmax becomes 30 m according to Equation 3. Similarly, when the difference between the first frequency $f_1$ and the second frequency $f_2$ is 2 MHz, the maximum distance rmax becomes 75 m according to Equation 3. When UHF band is used, the expected maximum communication distance is around 10 m. Thus, measurement of the type discussed herein is practically performable.

When measurement for a distance larger than the maximum distance rmax is required, the distance r can be measured by measuring the reception intensity of the reception signals as well as the above measurement.

More specifically, when it is possible that $\Delta\phi$ is $2\pi$ or larger, a prospective distance r' for the distance r can be calculated by the equation $r'=r+n\cdot rmax$ (n: 0 or larger integer). Thus, the value n can be specified by utilizing the characteristic that the reception intensity of the reception signals decreases as the distance r increases.

The measurement method shown in "Structure for Distance Measurement" and "Details of Distance Measurement" herein is only an example of measurement of the distance between the antenna 3 and the RFID tag 2, and the structure of the reader/writer 4 is not limited to this example. The structure of the reader/writer 4 may be other structures as long as they can measure the distance between the antenna 3 and the RFID tag 2 based on the signals received from the RFID tag 2.

When the active-type RFID tag is used, the distance may be measured based on the tag response signals actively sent from the RFID tag without transmission of the R/W requiring signals from the reader/writer 4.

(Use of Software)

The respective function blocks included in the communication control unit 13, the positioning unit 14, and the external communication unit 15 of the reader/writer 4, and the respective function blocks included in the control unit 22 of the management server 5 may be provided under hardware logic, or under programs stored in memory units such as ROM (read only memory) and RAM to be executed by a calculating unit such as CPU.

When these structures are constituted by the calculating unit such as CPU and the memory units, a computer including these units reads the programs recorded on a recording medium and executes the programs to provide various functions and processes of the respective function blocks included in the communication control unit 13, the positioning unit 14, and the external communication unit 15 of the reader/writer 4 and in the control unit 22 of the management server 5. When the programs are recorded on the removable recording medium, these various functions and processes can be provided by any computer.

The recording medium may be constituted by a not shown memory such as ROM as a program medium for the processing by the computer. Alternatively, a not shown program reading device is equipped as an external storage device, and a recording medium as a program medium is inserted into the program reading device so that the program reading device can read the programs on the recording medium.

In either of the cases, the stored programs are preferably executed by access of a microprocessor. The programs read by the microprocessor are preferably downloaded to the program storage area of the microcomputer so as to be executed. Programs used for downloading are stored in the main body in advance.

In the system structure capable of connecting with a communication network including the Internet, the recording medium is preferably of a type on which fluid programs downloaded from the communication network can be recorded.

When programs are downloaded from the communication network, programs used for downloading are preferably stored in the main body in advance or installed from another storage medium.

The invention is not limited to the embodiment described and depicted herein, but various modifications may be given within the scope of the appended claims. Thus, other examples as combinations of technical aspects which have been appropriately modified within the scope of the claims are included within the technical scope of the invention.

The recording control apparatus according to the invention can be used as a management server included in a security system which detects robbery of articles as commodities and executes appropriate processes at the time of robbery in a store or other places.

What is claimed is:

1. A recording control apparatus, comprising:

a communication processing unit for receiving position information on an RFID tag from a tag communication device which can measure the position of the RFID tag through radio communication with the RFID tag;

a database control unit for storing the position information on the RFID tag received by the communication processing unit in a database; and a recording control unit for controlling recording operation of a plurality of recording devices disposed at a plurality of positions, wherein:

the recording control unit estimates the movement direction of the RFID tag based on the time-sequential record of the position information on the RFID tag stored in the database, reads disposition information on the plural recording devices from a database storing this disposition information to specify any of the recording devices to be operated to record a region including the location of the RFID tag based on the position information and the movement direction of the RFID tag, and controls the recording operation of the specified recording device.

2. A recording control apparatus according to claim 1, wherein:

the recording control apparatus further comprises a position determining unit for determining whether the RFID tag the position information of which is received by the communication processing unit is located out of a predetermined area; and when the position determining unit determines that the RFID tag is located out of the predetermined area, the recording control unit controls recording of the RFID tag.

3. A recording control apparatus according to claim 1, wherein the recording control unit commands the recording devices to control panning or zoom based on the position information on the RFID tag and the disposition information on the recording device to be operated.

4. A recording control apparatus according to claim 2, wherein:

the recording control apparatus further comprises an alarm control unit for controlling alarm operation of a plurality of alarms disposed at a plurality of positions;

the alarm control unit estimates the movement direction of the RFID tag based on the time-sequential record of the position information on the RFID tag stored in the database, reads disposition information on the plural alarms from a database storing this disposition information to specify any of the alarms to be operated based on the position information and the movement direction of the RFID tag, and controls the alarm operation of the specified alarm device; and when the position determining unit determined that the RFID tag is located out of the predetermined area, the alarm control unit controls the alarm operation.

5. A recording control method, comprising:

a position information receiving step for receiving position information on an RFID tag from a tag communication device which can measure the position of the RFID tag through radio communication with the RFID tag;

a storing step for storing the position information on the RFID tag received by the communication processing unit in a database; and a recording control step for controlling recording operation of a plurality of recording devices disposed at a plurality of positions, wherein:

in the recording control step, the movement direction of the RFID tag is estimated based on the time-sequential record of the position information on the RFID tag stored in the database, disposition information on the plural recording devices is read from a database storing this disposition information to specify any of the recording devices to be operated to record a region including the location of the RFID tag based on the position information and the movement direction of the RFID tag, and the recording operation of the specified recording device is controlled.

6. A recording system, comprising:

the recording control apparatus according to any one of claims 1 through 4; and a database for storing the position information on the RFID tag received by the communication processing unit and the disposition information on the plural recording devices.

7. An information processing system, comprising:

the recording control system according to claim 6; and a tag communication device for measuring the position of an RFID tag through radio communication with the RFID tag.

* * * * *